US010410811B2

(12) United States Patent
Hanai et al.

(10) Patent No.: US 10,410,811 B2
(45) Date of Patent: Sep. 10, 2019

(54) POWER TOOL

(71) Applicant: MAKITA CORPORATION, Anjo-shi (JP)

(72) Inventors: Takamasa Hanai, Anjo (JP); Hikaru Sunabe, Anjo (JP); Satoshi Ninagawa, Anjo (JP); Shin Nakamura, Anjo (JP); Masatoshi Nakahama, Anjo (JP); Kazusa Fukuda, Anjo (JP); Kenichi Miyata, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 375 days.

(21) Appl. No.: 15/264,870

(22) Filed: Sep. 14, 2016

(65) Prior Publication Data

US 2017/0125192 A1 May 4, 2017

(30) Foreign Application Priority Data

Oct. 28, 2015 (JP) ..... 2015-211414

(51) Int. Cl.
*H01H 25/00* (2006.01)
*B24B 23/02* (2006.01)
(Continued)

(52) U.S. Cl.
CPC ..... *H01H 25/00* (2013.01); *B24B 23/028* (2013.01); *B25F 5/00* (2013.01); *B25F 5/02* (2013.01);
(Continued)

(58) Field of Classification Search
CPC . B25F 5/02; B25F 5/00; B24B 23/028; H01H 2231/048; H01H 9/20; H01H 25/00; H01H 9/06; H01H 21/00; H01H 2001/508
(Continued)

(56) References Cited

U.S. PATENT DOCUMENTS 4,135,134 A * 1/1979 Ebel ..... H01H 71/2463 335/20
4,401,958 A * 8/1983 Noorigian ..... H01H 3/503 307/142
(Continued)

FOREIGN PATENT DOCUMENTS

CN 101882523 A 11/2010
DE 102013212907 A1 1/2015
(Continued)

OTHER PUBLICATIONS

Extended European Search Report from the European Patent Office dated Apr. 12, 2017 in related EP application No. 16 188 596.7, including European Search Report and European Search Opinion.

*Primary Examiner* — Robert F Long
(74) *Attorney, Agent, or Firm* — J-Tek Law PLLC; Jeffrey D. Tekanic; Scott T. Wakeman

(57) ABSTRACT

A power tool (1) includes an electric motor (2) as a drive source and a start switch (20; 61) that starts the electric motor (2) and is lockable in an ON position in a lock-ON state. An electromagnetic actuator (30; 40; 50; 60) pushes out or pulls in an actuation pin (30*a;* 40*a;* 50*a;* 60*a*) with respect to a body of the electromagnetic actuator (30; 40; 50; 60) in response to cutting off of a supply of electrical current to the power tool (1). The pushed-out or pulled-in actuation pin, directly or indirectly, disengages the start switch (20; 61) from the lock-ON state and/or prevents the start switch (20; 61) from being shifted into the lock-ON state.

12 Claims, 15 Drawing Sheets

(51) Int. Cl.

| | |
|---|---|
| ***B25F 5/02*** | (2006.01) |
| ***H01H 9/06*** | (2006.01) |
| ***H01H 9/20*** | (2006.01) |
| ***H01H 21/00*** | (2006.01) |
| ***B25F 5/00*** | (2006.01) |
| *H01H 1/50* | (2006.01) |

(52) U.S. Cl.
CPC ..... *H01H 9/06* (2013.01); *H01H 9/20* (2013.01); *H01H 21/00* (2013.01); *H01H 2001/508* (2013.01)

(58) Field of Classification Search
USPC ..... 173/1–11, 13–21, 170, 141, 158, 173/160–161, 217
See application file for complete search history.

(56) References Cited

U.S. PATENT DOCUMENTS 4,591,301 A * 5/1986 Pelfrey ..... B25H 1/0071 408/135
4,601,349 A * 7/1986 Arentsen ..... E02D 7/10 173/200
4,757,684 A * 7/1988 Wright ..... F16K 31/047 251/59
4,879,535 A * 11/1989 Mori ..... H01H 89/08 335/14
5,013,950 A * 5/1991 Isozumi ..... F02N 15/066 290/48
5,371,646 A * 12/1994 Biegelmeier ..... H02H 3/33 361/45
5,401,928 A * 3/1995 Kelley ..... H01H 9/06 200/510
5,455,762 A * 10/1995 Braun ..... H02J 13/0062 700/24
5,525,948 A * 6/1996 Poulsen ..... H01H 3/503 335/128
5,701,961 A * 12/1997 Warner ..... B25B 21/00 173/15
5,872,499 A * 2/1999 Poulsen ..... H01H 3/503 335/177
5,945,742 A * 8/1999 Araki ..... F02N 15/065 290/38 A
5,999,870 A * 12/1999 Tatsumi ..... B62D 5/0436 180/443
6,262,648 B1 * 7/2001 Lammers ..... H01F 7/122 335/229
6,415,875 B1 * 7/2002 Meixner ..... B24B 23/028 173/171
6,469,268 B1 * 10/2002 Schaeffeler ..... H01H 15/18 200/405
6,742,601 B2 * 6/2004 Numata ..... B24B 23/028 173/170
7,516,801 B2 * 4/2009 Meixner ..... B25D 9/26 173/104
2002/0064388 A1 * 5/2002 Takahashi ..... G03B 9/18 396/484
2002/0088962 A1 * 7/2002 Takano ..... F16K 31/047 251/292
2003/0133239 A1 * 7/2003 Feil ..... H02H 11/00 361/72
2004/0155743 A1 * 8/2004 Sako ..... B25C 1/06 335/220
2004/0159449 A1 * 8/2004 Leitenberger ..... B25B 21/00 173/2
2005/0236594 A1 * 10/2005 Lilly ..... F16K 31/02 251/129.03
2006/0060364 A1 * 3/2006 Lam ..... H01H 3/20 173/2
2007/0229202 A1 * 10/2007 Gao ..... H01H 9/161 335/18
2010/0116863 A1 * 5/2010 Suda ..... B25C 1/008 227/8
2010/0140519 A1 * 6/2010 Kopecek ..... F16K 31/0655 251/129.15
2010/0175972 A1 7/2010 Kimata et al.
2011/0139473 A1 * 6/2011 Braun ..... B25D 16/003 173/20
2011/0248583 A1 * 10/2011 O'Banion ..... B25B 21/00 310/50
2011/0278035 A1 * 11/2011 Chen ..... B25F 5/001 173/170
2011/0308920 A1 12/2011 Shi et al.
2013/0186661 A1 7/2013 Okubo et al.
2014/0245620 A1 * 9/2014 Fankhauser ..... B25F 5/001 30/374
2015/0129267 A1 * 5/2015 Lee ..... B25F 5/00 173/1
2015/0130330 A1 5/2015 Nagy et al.
2017/0072532 A1 3/2017 Kawakami et al.
2017/0072533 A1 3/2017 Yoshizaki et al.
2017/0072534 A1 3/2017 Nakamura et al.
2017/0072535 A1 3/2017 Iwakami et al.
2017/0125192 A1 * 5/2017 Hanai ..... B24B 23/028

FOREIGN PATENT DOCUMENTS

DE 102013221915 A1 4/2015
EP 2207191 A2 7/2010
JP 2012076160 A 4/2012
WO 2010069105 A1 6/2010

* cited by examiner

POWER TOOL

CROSS-REFERENCE

This application claims priority to Japanese patent application no. 2015-211414 filed on Oct. 28, 2015, the contents of which are fully incorporated herein by reference.

TECHNICAL FIELD

The present disclosure relates to a power tool such as a disc grinder.

BACKGROUND ART

In a disc grinder used for cutting, grinding, and/or performing other operations on stone, concrete, or the like, switching a start switch to the ON side (ON position) starts an electric motor and thereby rotates a circular grinding wheel. The start switch is configured such that it can be locked (a so-called "lock-ON" function or feature) in the actuated or ON state so that the user is not required to continuously hold the start switch in the ON position while using the grinder to process a workpiece, thereby facilitating the processing work. Japanese Laid-open Patent Publication 2012-76160 and its English counterpart US 2013/0186661 disclose a technique in which the lock-ON function of the start switch is implemented by microcontroller control (motor control), which controls the actuation of the electric motor serving as a drive source.

SUMMARY

However, when such a lock-ON feature (function) is provided, it is necessary to reliably prevent the situation from arising in which the lock-ON state is not released (disabled) when the supply of electric power is cut off, e.g., during a power failure, because the motor will inadvertently restart after the supply of electric power returns (resumes) if the start switch remains in the lock-ON state. In the above-described known art, because the release (disabling) of the lock-ON function when the electric power is cut off is configured in an electrical manner under motor control, the increased complexity of the motor control leads to an increase in size and cost. One object of the present disclosure is provide techniques to release or disable the lock-ON function in response to the supply of electric power being cut off (interrupted), without depending on electric motor control and without leading to increased size and cost.

The aforementioned problem is solved by one or more of the aspects below. In a first aspect of the disclosure, a power tool, in which an electric motor is built in as a drive source, comprises a start switch that starts the electric motor. In a lock-ON state in which the start switch is locked in the ON position, if the supply of electric current is cut off (interrupted), then the lock-ON state of the start switch is released or disabled by pushing out or advancing an actuation pin of an electromagnetic actuator that is configured to push out/advance the actuation pin when the electric current is cut off.

According to the first aspect of the disclosure, as a means for releasing or disabling the lock-ON state of the start switch, the electromagnetic actuator is preferably designed such that, if the supply of electric current is cut off (interrupted), then the actuation pin is actuated (moved) in the pushed out direction. Thus, when the supply of electric power is cut off, such as in a power failure, the actuation pin of the electromagnetic actuator is pushed out from (advanced out of) a body of the electromagnetic actuator and the lock-ON state of the start switch is released or disabled. Therefore, when the supply of electric power subsequently returns (resumes), the electric motor does not start, thereby preventing an inadvertent startup of the power tool. The power tool according to the first aspect of the disclosure is preferably configured such that the lock-ON state of the start switch is released or disabled by utilizing the actuation of the electromagnetic actuator; i.e. it is not configured in an actuation control of the electric motor, as in the above-described known art. Therefore, the controller that controls the actuation (driving) of the electric motor can be made more compact and, consequently, the power tool can be reduced in size and cost.

In a second aspect of the disclosure, a power tool, in which an electric motor is built in as a drive source, comprises a start switch that starts the electric motor. In the lock-ON state in which the start switch is locked at the ON position, if the supply of electric current is cut off (interrupted), then the lock-ON state of the start switch is released or disabled by pulling in (retracting) an actuation pin of an electromagnetic actuator that is configured to pull in the actuation pin when the electric current is cut off.

According to the second aspect of the disclosure, as a means for releasing or disabling the lock-ON state of the start switch, the electromagnetic actuator is preferably designed such that, if the supply of electric current is cut off, then the actuation pin is retracted or pulled into the body of the electromagnetic actuator. When the supply of electric power is cut off, such as in a power failure, the actuation pin of the electromagnetic actuator retracts and the lock-ON state of the start switch is released or disabled. Therefore, when the supply of electric power subsequently returns (resumes), the electric motor does not start, thereby preventing an inadvertent startup of the power tool. Thus, the power tool according to the second aspect of the disclosure is also preferably configured such that the lock-ON state of the start switch is released or disabled by utilizing the actuation of the electromagnetic actuator; i.e. it is also not configured in an actuation control of the electric motor, as in the above-described known art. Therefore, in the second aspect as well, the controller that controls actuation (driving) of the electric motor can be made more compact and, consequently, the power tool can be reduced in size and cost.

A third aspect of the disclosure is the power tool according to either of the first or second aspect of the disclosure, wherein the start switch is supported by a support-pedestal part of a main-body housing such that it is configured to slide between the ON position and an OFF position, and is supported in the ON position such that it is tiltable or pivotable between a lock-ON position and a lock-OFF position. When the start switch is in the ON position and is tilted or pivoted to the lock-ON position, it is held at (in) the lock-ON position by the engagement of a lock part with the support-pedestal part.

According to the third aspect of the disclosure, the electric motor can be started by the start switch being slid to the ON position. Then, by tilting the start switch while it is at the ON position, and engaging the lock part with the support-pedestal part, the start switch can be locked (mechanically engaged) at (in) the ON position. When the supply of electric current is cut off, the lock-ON state of the start switch is physically (mechanically) released (disengaged) by the actuation of the electromagnetic actuator, and thereby the power tool is prevented from inadvertently starting when the supply of electric current subsequently resumes.

A fourth aspect of the disclosure is the power tool according to any one of the first to third aspects of the disclosure, wherein an intermediate lever is interposed between the start switch and the electromagnetic actuator, and wherein the intermediate lever is tilted or pivoted by the actuation (movement) of the actuation pin of the electromagnetic actuator, thereby releasing or disabling the lock-ON state of the start switch.

According to the fourth aspect of the disclosure, the degrees of freedom in the arrangement of the electromagnetic actuator can be increased. In addition, the thrust of the actuation pin of the electromagnetic actuator is amplified by the leverage of the intermediate lever and that thrust can be used as the operating force that releases or disables the lock-ON state of the start switch. Therefore, the electromagnetic actuator can be reduced in size. Furthermore, by changing or shifting the positional relationship between a tilt fulcrum of the intermediate lever and the point of contact on the start switch, any type of electromagnetic actuator that either pulls in (retracts) or pushes out (advances) in response to the cutoff of the electric current supply can be selected and utilized in an unrestricted manner.

A fifth aspect of the disclosure is the power tool according to the second aspect of the disclosure, wherein the start switch directly engages with the actuation pin of the electromagnetic actuator, and thereby locks the start switch, at (in) the ON position. For example, the start switch may be configured to: (i) directly engage or latch the actuation pin of the electromagnetic actuator in the ON position of the start switch when the electromagnetic actuator is in a first configuration (e.g., the actuation pin is pushed out of the body of the electromagnetic actuator), thereby locking the start switch in the lock-ON state; and (ii) disengage or unlatch from the actuation pin when the electromagnetic actuator is in a second configuration (e.g., the actuation pin is pulled into the body of the electromagnetic actuator) so that the lock-ON state is released or disabled.

According to the fifth aspect of the disclosure, because the start switch directly engages or latches the actuation pin of the electromagnetic actuator, which is, e.g., in a state of being pushed out owing to the supply of electric current, in the lock-ON state, the start switch is locked at (in) the ON position by the actuation pin. In this lock-ON state, when the supply of electric current to the electromagnetic actuator is cut off by the cutoff of the supply of electric power to the power tool, the actuation pin is pulled in (retracted) and disengages or unlatches from the start switch, thereby releasing or disabling the lock-ON state of the start switch. According to the fifth aspect of the invention, because a configuration is provided in which the start switch directly engages with the actuation pin, the configuration (structural elements) of the lock-ON mechanism can be simplified and reduced in cost more than in a configuration in which the start switch is indirectly engaged via one or more other structural elements, such as an intermediate lever.

DETAILED DESCRIPTION

Figure 1:
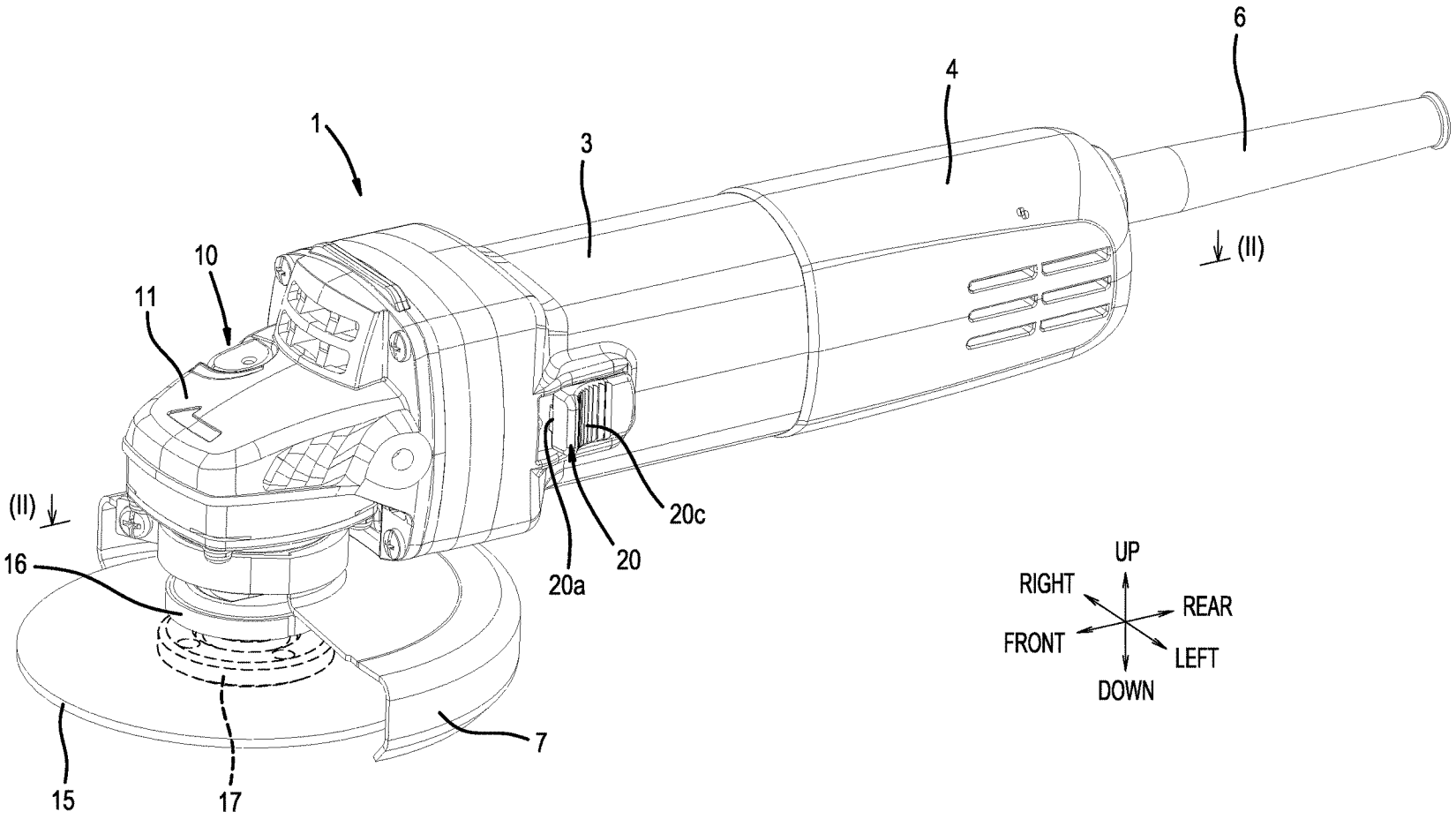
FIG. 1 is an overall-oblique view of a power tool according to a first embodiment of the present disclosure.

Next, embodiments of the present disclosure will be explained with reference to FIGS. 1 to 17, in which a disc grinder will be utilized as one representative, non-limiting example of a power tool 1 according to the present teachings. FIGS. 1-5 show a power tool 1 according to a first embodiment. In the first exemplary power tool 1, an electric motor 2, which serves as a drive source, is built into (mounted or disposed within) a main-body housing 3. The main-body housing 3 has a substantially cylindrical shape of a size that is easy to grip by a user. The user grips the main-body housing 3 and is positioned (stands) rearward (the right side in FIG. 1 and FIG. 2) of the power tool 1. Hereinbelow, the front, rear, left, and right directions of members, structural elements, and the like are denoted with reference to a user holding the power tool 1 in a normal operating state.

A rear-part case 4 is joined to a rear part of the main-body housing 3. A switch main body (power switch) 5 is housed in the rear-part case 4. A power-supply cord 6 for supplying electric power (current) is routed through the rear part of the rear-part case 4. An alternating electric current in the range of 100-240 volts (mains electricity) is supplied via the power-supply cord 6.

A cooling fan 18 is attached to an output shaft 2*a* of the electric motor 2. Upon starting the electric motor 2, the cooling fan 18 rotates together with the electric motor 2, thereby drawing outside air into the main-body housing 3 and cooling the electric motor 2. The rear side of the cooling fan 18 is covered by a baffle plate 19, which is attached at the side of the cooling fan 18 facing the main-body housing 3. Because the rear side of the cooling fan 18 is covered by the baffle plate 19, a cooling draft that flows from the rear side toward the front side of the main-body housing 3 as the cooling fan 18 rotates is efficiently generated.

A gear-head case 11 of a gear-head part 10 is joined to a front part of the main-body housing 3. A drive-side bevel gear 12 is attached to the output shaft 2*a* of the electric motor 2. The bevel gear 12 meshes with a follower-side bevel gear 13. The follower-side bevel gear 13 is joined to a spindle 14. The spindle 14 is supported such that it is rotatable relative to the gear-head case 11 around an axis line orthogonal to the output shaft 2*a* of the electric motor 2. A lower part of the spindle 14 protrudes downward from a lower surface of the gear-head case 11.

A circular grinding wheel 15 (one representative, non-limiting example of a tool accessory that may be driven by the spindle 14) is attached to the lower part of the spindle 14 that protrudes from the lower surface of the gear-head case 11. The grinding wheel 15 is attached to the spindle 14 such that the grinding wheel 15 is interposed between an inner flange 16 and an outer flange 17. A grinding-wheel cover 7 covers a substantially semicircular area of the rear side of the grinding wheel 15. The grinding-wheel cover 7 prevents the dispersion of dust, chips or the like towards the user (i.e. in the rearward direction).

A start switch 20 is disposed on a left-side surface of the front part of the main-body housing 3. The start switch 20 is configured to slide in the forward-rearward direction and is provided along a flat support-pedestal part 3*a* on a left-side part of the main-body housing 3. When the start switch 20 is slid toward the front side, e.g., by a fingertip (e.g., a thumb) of the hand that grips the main-body housing 3, the electric motor 2 starts and the grinding wheel 15 rotates. When the start switch 20 is slid toward the rear side, the electric motor 2 stops and consequently the grinding wheel 15 stops.

A lock part (latch) 20*a* and an arm part 20*b* are integrally provided on the start switch 20. The left-side, outer surface of the start switch 20 is designed as a pressing (pressable) part 20*c*, which extends in the leftward direction in an arc shape, and is configured to be pressed by a user's finger (e.g., thumb). A jagged, slip-preventing part is formed on the outer surface of the pressing part 20*c* that is pressed by the user's finger. The lock part 20*a* protrudes in the rightward direction (i.e. towards the interior of the main-body housing 3) from the front end of the pressing part 20*c*.

The arm part 20*b* protrudes toward the interior of the main-body housing 3 through an insertion window 3*b*, which is provided in (penetrates through) the support-pedestal part 3*a* of the main-body housing 3. The arm part 20*b* is coupled to a front part of a connecting rod (intermediate lever) 21. A rear part of the connecting rod 21 is coupled to a switch frame 23 via a tension spring 22. The switch frame 23 is disposed around leftward and rearward portions of the switch main body 5 and is supported so as to be movable in the forward-rearward direction of the power tool 1. When the start switch 20 is slid forward toward the ON position, the switch frame 23 is displaced (pulled) forward by the connecting rod 21 and the tension spring 22, thereby pressing forward (inward) an actuation button 5*a* of the switch main body 5 and turning ON the switch main body 5. When the switch main body 5 turns ON, the electric motor 2 starts.

When the start switch 20 returns rearward to its OFF position, the switch frame 23 is displaced rearward by the connecting rod 21, thereby releasing the actuation button 5*a* of the switch main body 5 and turning OFF the switch main body 5. When the switch main body 5 turns OFF, the electric motor 2 stops. Because the tension spring 22 is interposed between the connecting rod 21 and the switch frame 23, the biasing force of the tension spring 22 is continuously applied, via the switch frame 23, to the actuation button 5*a* of the switch main body 5 and therefore, a large pushing force is not directly applied to the actuation button 5*a* and the switch main body 5.

Figure 2:
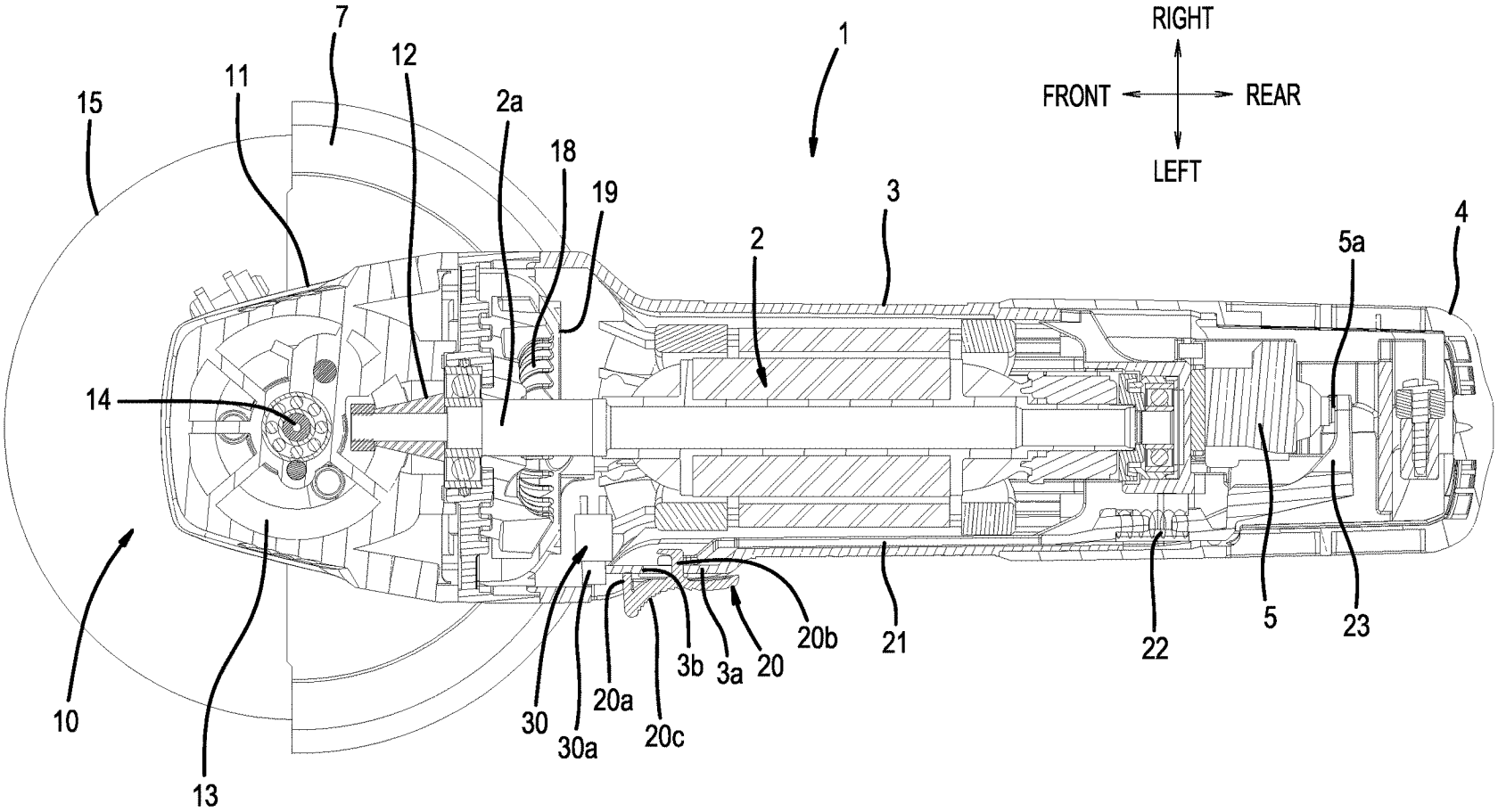
FIG. 2 is a cross-sectional auxiliary view taken along line (II)-(II) in FIG. 1 and is a transverse cross-sectional view of the power tool according to the first embodiment. This figure shows the state in which a start switch is in an OFF position prior to the supply of electric current and shows the state in which an actuation pin of an electromagnetic actuator is pushed out (advanced).

The actuation button 5*a* of the switch main body 5 is spring-biased toward its OFF side (the protruding side, i.e. rearward). Consequently, the direction of the sliding (the ON operation) of the start switch 20 toward the front side is opposite of the direction of the biasing force of the tension spring 22 and the spring-biasing force of the actuation button 5*a*. Conversely, when the pressing force on (sliding of) the start switch 20 toward the front side is released, the start switch 20 returns rearward to its OFF position owing to the biasing force of the tension spring 22 and the spring-biasing force of the actuation button 5*a*. FIG. 1 and FIG. 2 show the state in which the start switch 20 has returned to the OFF position.

The start switch 20 can be locked at (in) the ON position on the front side in a lock-ON state. That is, after the start switch 20 has been slid by a fingertip to the ON position on the front side so that the lock part 20*a* is laterally adjacent to the support-pedestal part 3*a*, if the tip side of the start switch 20 (i.e. the lock part 20*a*) is then pushed radially inward (in the right direction) with respect to the substantially-cylindrical main-body housing 3, then the lock part 20*a* will catch (latch) on a front-end part of the support-pedestal part 3*a*, i.e. the lock part 20*a* engages or latches on the front-end part of the support-pedestal part 3*a*. In this caught (engaged) state, the biasing force of the tension spring 22 acts on the start switch 20 via the connecting rod 21, thereby holding the start switch 20 in this position, i.e. in the lock-ON state. The lock-ON state, in which the lock part 20*a* is caught by (engaged with) the front-end part of the support-pedestal part 3*a*, can be released (disengaged or unlatched) manually by the user, for example, by pressing the rear side of the start switch 20 towards the housing 3 (i.e. radially inward with respect to the cylindrical housing 3 or in the direction of the right arrow shown in FIG. 4) with his or her fingertip.

Figure 3:
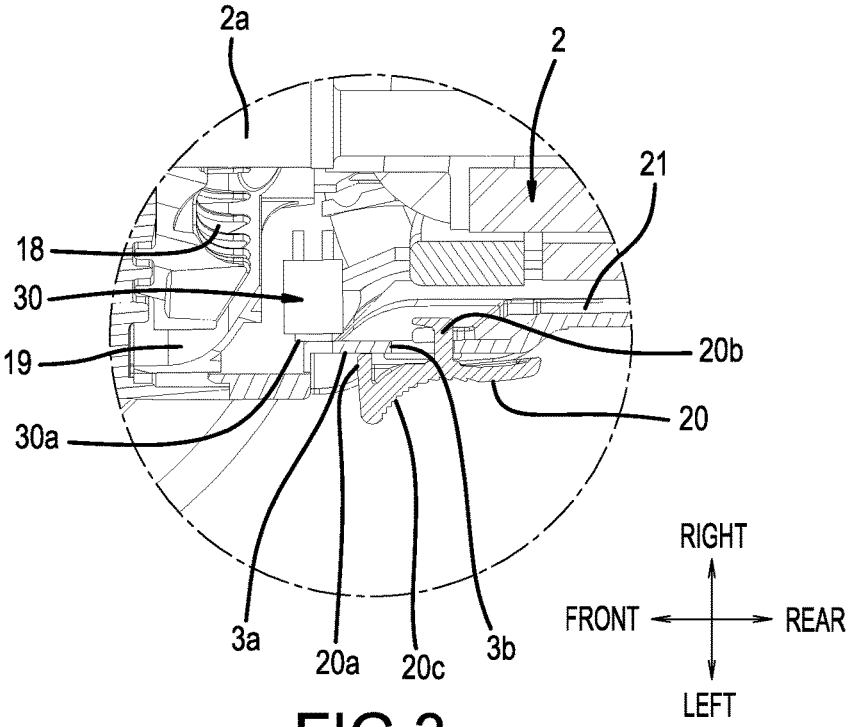
FIG. 3 is a transverse cross-sectional view of the vicinity of the start switch. This figure shows the state in which the actuation pin of the electromagnetic actuator is pulled in (retracted) due to the supply of electric current to the electromagnetic actuator and shows the state in which the start switch is still in the OFF position.
Figure 4:
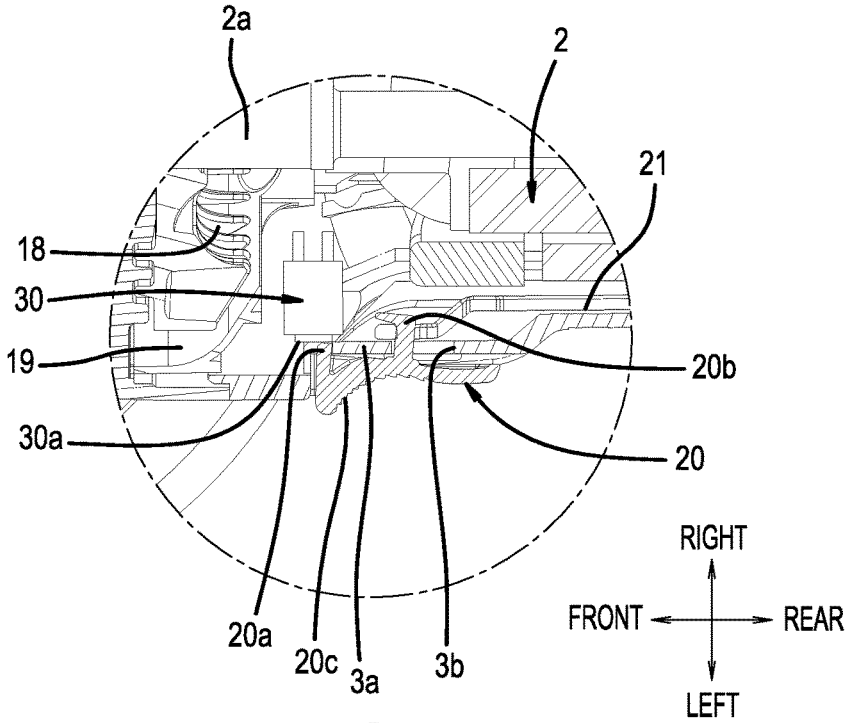
FIG. 4 is another transverse cross-sectional view of the vicinity of the start switch. This figure shows the state in which the actuation pin of the electromagnetic actuator has been pulled in due to the supply of electric current and shows a lock-ON state in which the start switch has been locked at (in) an ON position.
Figure 5:
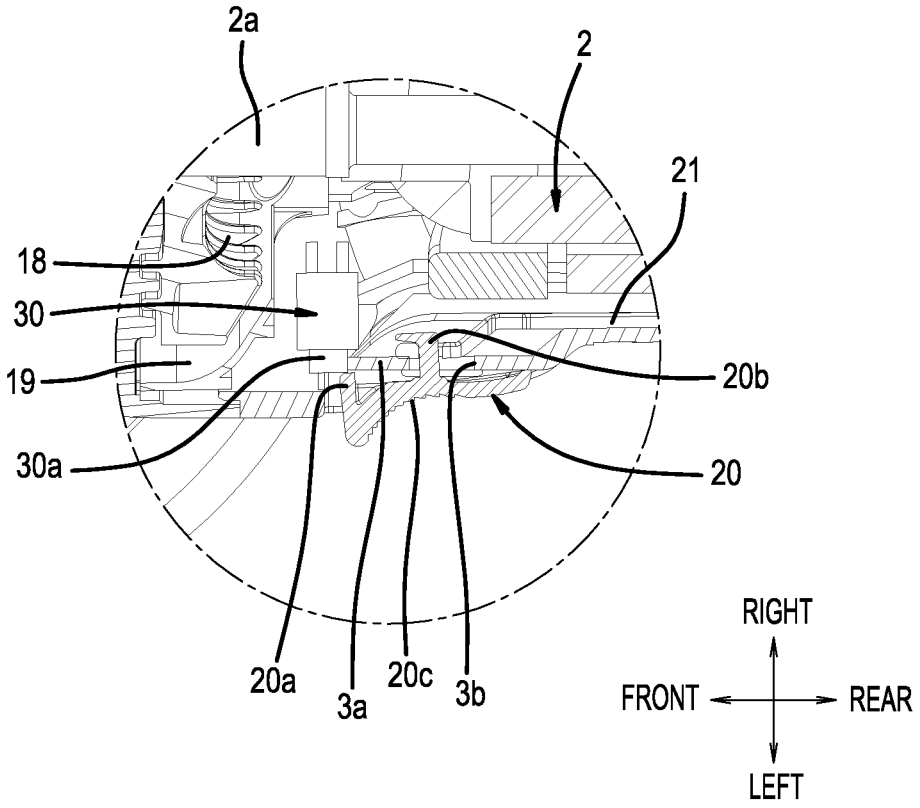
FIG. 5 is another transverse cross-sectional view of the vicinity of the start switch. This figure shows the state in which the actuation pin of the electromagnetic actuator has been pushed out due to the supply of electric current being cut off and shows the state immediately after the lock-ON state of the start switch has been released or disabled.
Figure 6:
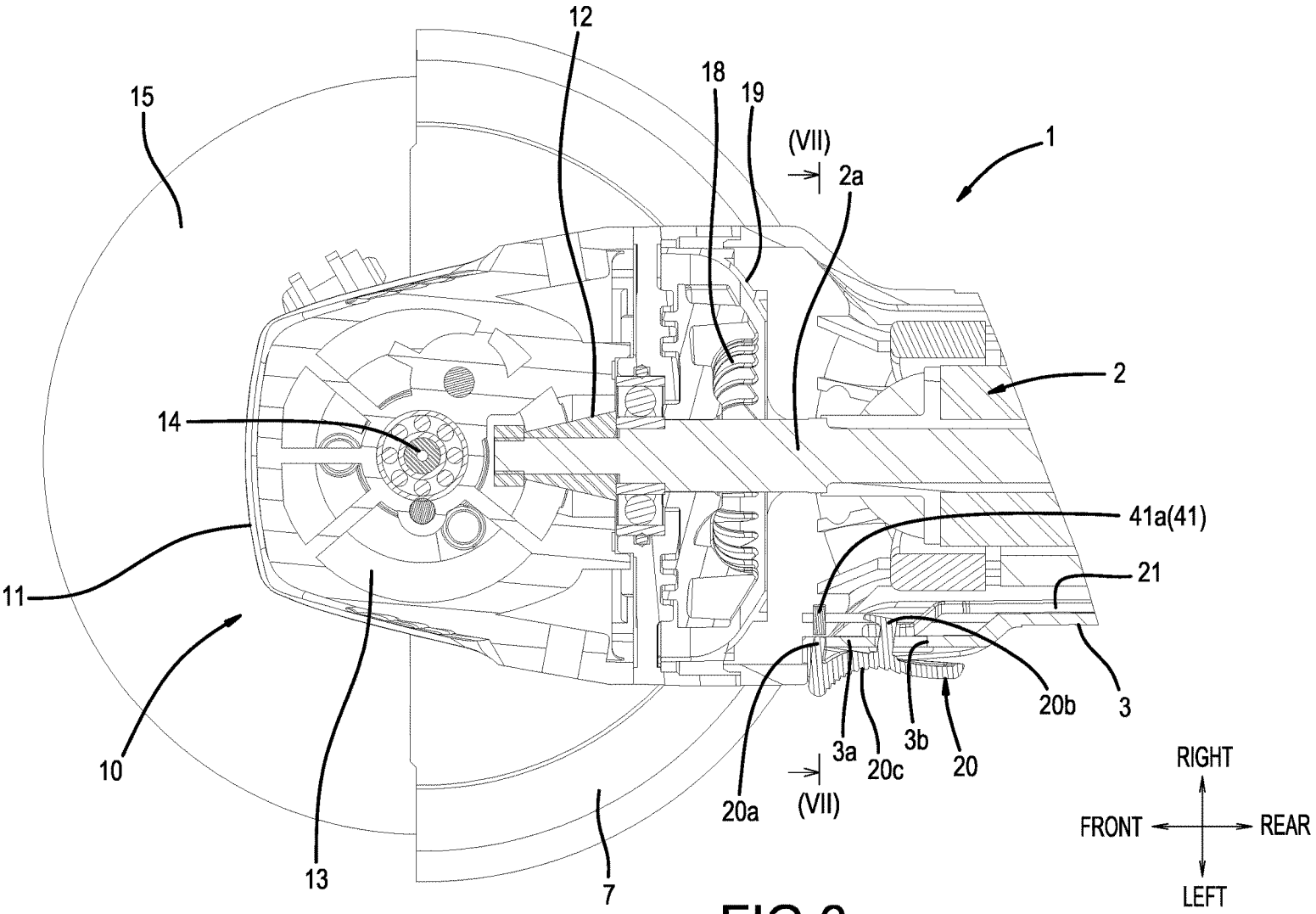
FIG. 6 is a longitudinal-cross-sectional view of a front portion of the power tool according to a second embodiment. This figure shows the lock-ON state of the start switch.

The power tool 1 of the present embodiment also includes a mechanism for automatically releasing, disabling and/or preventing the lock-ON state of the start switch 20 when the supply of electric power is cut off (interrupted). As shown in FIGS. 2-5, an electromagnetic actuator 30 is built into (disposed on) the front side of the support-pedestal part 3*a* of the main-body housing 3. In the present embodiment, the electromagnetic actuator 30 is designed such that, when it is supplied with electric current, an actuation pin 30*a* is pulled (retracted) into a body of the actuator 30 by a magnetic force, as shown in FIGS. 3 and 4. Conversely, when the electric power is cut off (interrupted) and the magnetic field is thus dissipated, the actuation pin 30*a* is actuated (moved) in a pushing out (advancing) direction by a spring force of a return spring that biases the actuation pin 30*a* towards the pushed out (advanced) position. Therefore, the return spring causes the actuation pin 30*a* to advance or move so that it protrudes out of the body of the actuator 30, as shown in FIGS. 2 and 5. Electric power is supplied to the electromagnetic actuator 30 via the power-supply cord 6, the same as for the electric motor 2. Electric current (power) at a proper voltage is supplied to the electromagnetic actuator 30 when the 100-240 V mains electricity is supplied via the power-supply cord 6. If the power-supply cord 6 is pulled out of the power-supply outlet (either intentionally or accidentally), then the supply of electric power to the power tool 1 is cut off (interrupted) and consequently the supply of electric current to the electromagnetic actuator 30 is also cut off (interrupted).

Thus, when the supply of electric current to the electromagnetic actuator 30 is cut off, the actuation pin 30*a* is pushed out (moved to its advanced position), as shown in FIGS. 2 and 5. When the actuation pin 30*a* is pushed out, the front-end part of the support-pedestal part 3*a* is closed up or blocked by the actuation pin 30*a*. Consequently, when the actuation pin 30*a* has been pushed out, although the start switch 20 can still be slid to the ON position, the lock part 20*a* thereof cannot be caught by (latch on) or engage the front-end part of the support-pedestal part 3*a* due to the presence (blocking effect) of the actuation pin 30*a*.

In contrast, as shown in FIG. 3, when the power-supply cord 6 is connected to the power-supply outlet and electric power is supplied to the electric motor 2, electric current is simultaneously supplied to the electromagnetic actuator 30, thereby causing the actuation pin 30*a* to be pulled (retracted) into the body of the electromagnetic actuator 30 and opening (unblocking) the front-end part of the support-pedestal part 3*a*. In order words, when the actuation pin 30*a* retracts inwardly towards the center of the main-body housing 3 and thereby the front-end part of the support-pedestal part 3*a* is opened (unblocked), the lock part 20*a* of the start switch 20 is once again capable of being caught by (latched on or engaged with) the front-end part of the support-pedestal part 3*a*.

Consequently, as shown in FIG. 4, when the start switch 20 is slid forward to the ON position and then the front part of the start switch 20 is pressed inward (rightward) toward the center (interior) of the housing 3, the lock part 20*a* can be caught by (latched on) or engage with the front-end part of the support-pedestal part 3*a*. Thereafter, the state in which the lock part 20*a* is caught by (latched on) the support-pedestal part 3*a* is maintained by the biasing force of the tension spring 22 that pulls on (tensions) the start switch 20 via the connecting rod 21. By maintaining the condition in which the lock part 20*a* of the start switch 20 is caught by (latched on) the front-end part of the support-pedestal part 3*a*, the start switch 20 is (remains) locked at (in) the ON position (in the lock-ON state). By locking the start switch 20 at (in) the ON position, there is no longer a need for the user to continuously press, using his or her fingertip, the start switch 20 towards the ON position side during a power tool operation. Therefore, grinding work or the like can be performed comfortably for a long time, thereby improving the work efficiency and ergonomics of the power tool 1.

If the supply of electric power to the power tool 1 is cut off while the start switch 20 is engaged in the lock-ON state, for example, by the power-supply cord 6 mistakenly being pulled out of the power-supply outlet or by the occurrence of a power failure, then the supply of electric power to the electromagnetic actuator 30 is also cut off, which causes the actuation pin 30*a* to be actuated (advanced) in the pushed out (ejection) direction. As shown in FIG. 5, when the actuation pin 30*a* of the electromagnetic actuator 30 is pushed out (advanced), the lock part 20*a* of the start switch 20 is pressed (pushed outward) by the actuation pin 30*a* and thereby separates (disengages or unlatches) from the front-end part of the support-pedestal part 3*a*. This separation causes the start switch 20 to return (slide) rearward (to the OFF position side) owing principally to the biasing force of the tension spring 22, and thereby causes the switch main body 5 to turn OFF.

Thus, if the supply of electric power is cut off in the lock-ON state of the start switch 20, then the lock-ON state is automatically released (disabled) and the switch main body 5 turns off. Consequently, when the supply of electric power subsequently returns (resumes), the electric motor 2 does not automatically start in a manner that would be contrary to the intention of the user, because the start switch 20 was previously moved back to its OFF position. After the supply of electric power resumes and the user once again turns ON the start switch 20, then the electric motor 2 will start and the user can perform work using the power tool 1. In addition, because the actuation pin 30*a* of the electromagnetic actuator 30 is actuated (moved) to the pulled-in side by the resumption of the supply of electric power, the user can perform work without having to hold the start switch 20 for as long as the start switch 20 remains in the lock-ON state.

According to the embodiment explained above, if the supply of electric power to the power tool 1 is cut off, then the actuation pin 30*a* of the electromagnetic actuator 30 is actuated (advanced) to the pushed out side and the lock-ON state of the start switch 20 is forcibly released (disengaged or unlatched). As a result, when the supply of electric power returns (resumes), the electric motor 2 will not automatically start in an unintended manner, thereby preventing an inadvertent startup of the power tool 1. The embodiment described above is configured such that the lock-ON state of the start switch 20 is released (disengaged) by the electromagnetic actuator 30 and thus this release (disengagement) is not in the actuation control of the electric motor, as in the known example described above in the background section. Therefore, the controller that controls the actuation of the electric motor can be simplified and made more compact, thereby enabling a reduction of size and cost of the power tool 1.

In addition, after the work ends, the start switch 20 is switched to the OFF side, thereby stopping the electric motor 2. If the power-supply cord 6 is subsequently pulled out of the power-supply outlet, then the actuation pin 30*a* of the electromagnetic actuator 30 will be held in the state that it is pushed out (i.e. it is maintained in the pushed out or advanced position). Consequently, when the power tool 1 is not in use (e.g., when in storage), the lock-ON operation is prevented from being mistakenly performed even if, for example, some other structural element or a person interferes with (e.g., accidentally slides) the start switch 20 to its ON position. In this manner, an inadvertent start up is reliably prevented when the power tool 1 is subsequently reconnected to a supply of electric power, e.g., when the power cord 6 is plugged into an electric outlet (mains power) again.

In the embodiment as explained above, various modifications are possible. The first embodiment described above illustrates a configuration in which the lock part 20*a* of the start switch 20 is directly pressed by the actuation pin 30*a* of the electromagnetic actuator 30, thereby releasing the lock-ON state of the start switch 20. However, as shown in FIGS. 6-11, for example, a second embodiment may be utilized in which an intermediate lever 41 is operably interposed between an actuation pin 40*a* and the lock part 20*a* so that the lock part 20*a* is indirectly pressed towards the released side. In the following explanation of such a modification, members and structural elements not requiring modification are assigned the same reference numbers, and redundant explanations thereof are therefore omitted.

Figure 7:
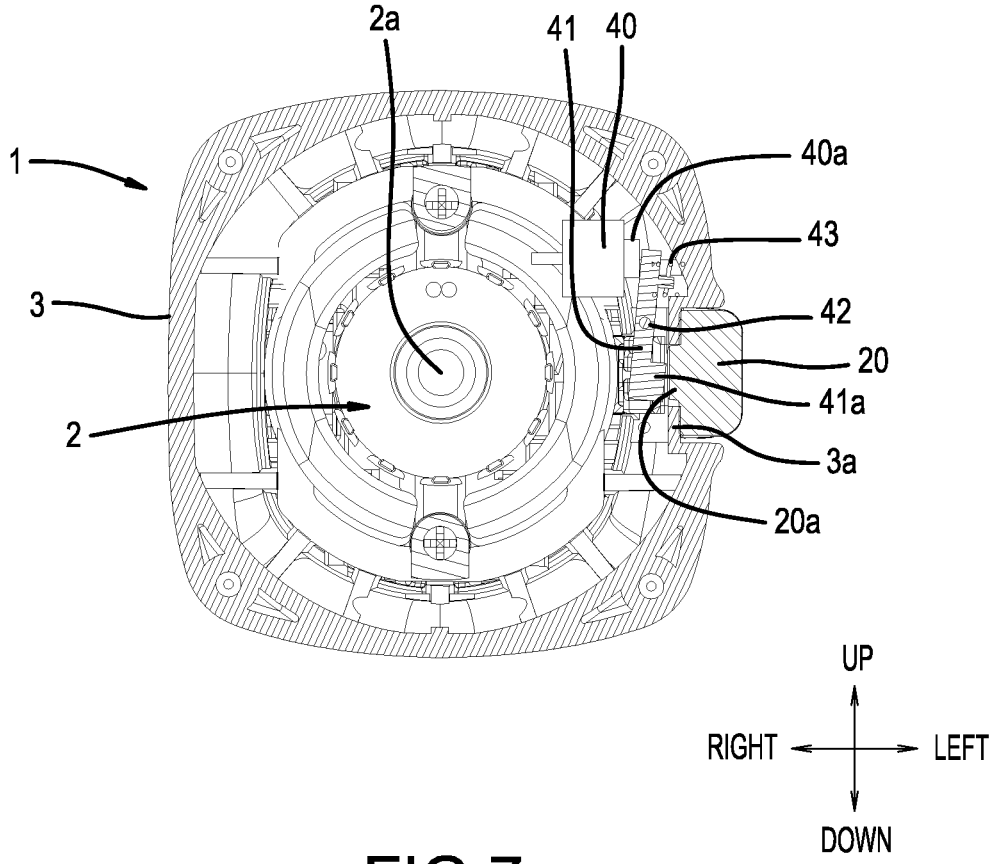
FIG. 7 is a cross-sectional auxiliary view taken along line (VII)-(VII) in FIG. 6. This figure shows the state in which the actuation pin of the electromagnetic actuator has been pushed out due to the supply of electric current.

In the second embodiment, as shown in FIG. 7, the intermediate lever 41 is provided such that it is capable of tilting or pivoting, about a pivot (fulcrum) 42, along the inner side of the support-pedestal part 3*a* of the main-body housing 3. More specifically, in this second embodiment, the intermediate lever 41 is supported such that it is capable of tilting or pivoting about the pivot 42 at substantially its center in the longitudinal direction of the intermediate lever 41. As shown in FIG. 7, an electromagnetic actuator 40 is disposed on one side of an upper end of the pivot 42. A compression spring 43 is interposed between the upper end of the intermediate lever 41 and the main-body housing 3 on the side of the intermediate lever 41 opposite the electromagnetic actuator 40. The intermediate lever 41 is biased about the pivot 42 by the compression spring 43 in a counterclockwise direction as shown in FIG. 7.

In the second embodiment, the electromagnetic actuator 40 includes an actuation pin 40*a* that actuates (moves) reversely (in an opposite direction) to the movement direction of the actuation pin 30*a* of the electromagnetic actuator 30 of the first embodiment. That is, in the second embodiment, when electric current is supplied to the electromagnetic actuator 40, the actuation pin 40*a* is pushed out (advanced) by an electromagnetic force. When the actuation pin 40*a* is pushed out (advanced out of the body of the actuator 40), the intermediate lever 41 tilts (pivots) about the pivot 42 in the clockwise direction, as shown in FIG. 7. The operation of tilting (pivoting) in the clockwise direction goes against the biasing force of the compression spring 43 and thus the compression spring 43 is compressed by the intermediate lever 41 in the pushed out (advanced) position of the actuation pin 40*a*.

When the intermediate lever 41 is tilted in the clockwise direction in FIG. 7, an engaging (contacting or pressing) part 41*a*, which is provided on a lower end of the intermediate lever 41, is displaced in the right direction (according to the directional arrows shown in FIG. 7, which is leftward from the perspective of a person viewing FIG. 7). i.e. in the clockwise direction, away from the end part of the support-pedestal part 3*a* of the main-body housing 3. When the engaging part 41*a* is spaced apart from the end part of the support-pedestal part 3*a*, the lock part 20*a* can be caught by (latched on) the end part of the support-pedestal part 3*a*, which means that the start switch 20 can be moved (pivoted) into the lock-ON position.

Figure 9:
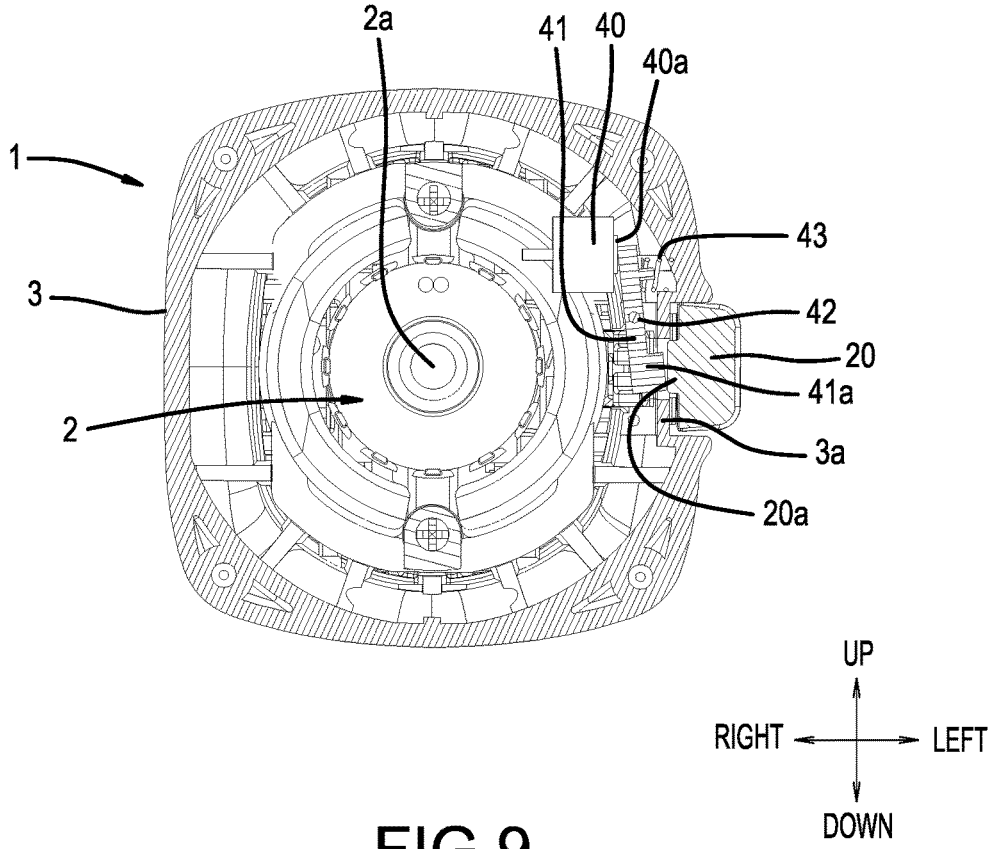
FIG. 9 is a cross-sectional auxiliary view taken along line (IX)-(IX) in FIG. 8. This figure shows the state in which the actuation pin of the electromagnetic actuator has been pulled in due to the supply of electric current being cut off.

If the supply of electric power to the power tool 1 is subsequently cut off such that the supply of electric current to the electromagnetic actuator 40 is also cut off, then the actuation pin 40*a* is actuated (moved) to the pulled-in side (that is, it retracts), as shown in FIG. 9, owing to the absence of a magnetic force acting on the actuation pin 40*a* and the biasing force of the compression spring 43. In other words, the actuation pin 40*a* is pulled (pushed) into the body of the actuator 40, because the upper end of the intermediate lever 41 is pressed towards the electromagnetic actuator 40 by the biasing force of the compression spring 43. As a result, the intermediate lever 41 tilts (pivots) about the pivot 42 in the illustrated counterclockwise direction as can be understood by comparing the tilting postures of the intermediate lever 41 in FIGS. 7 and 9.

Figure 8:
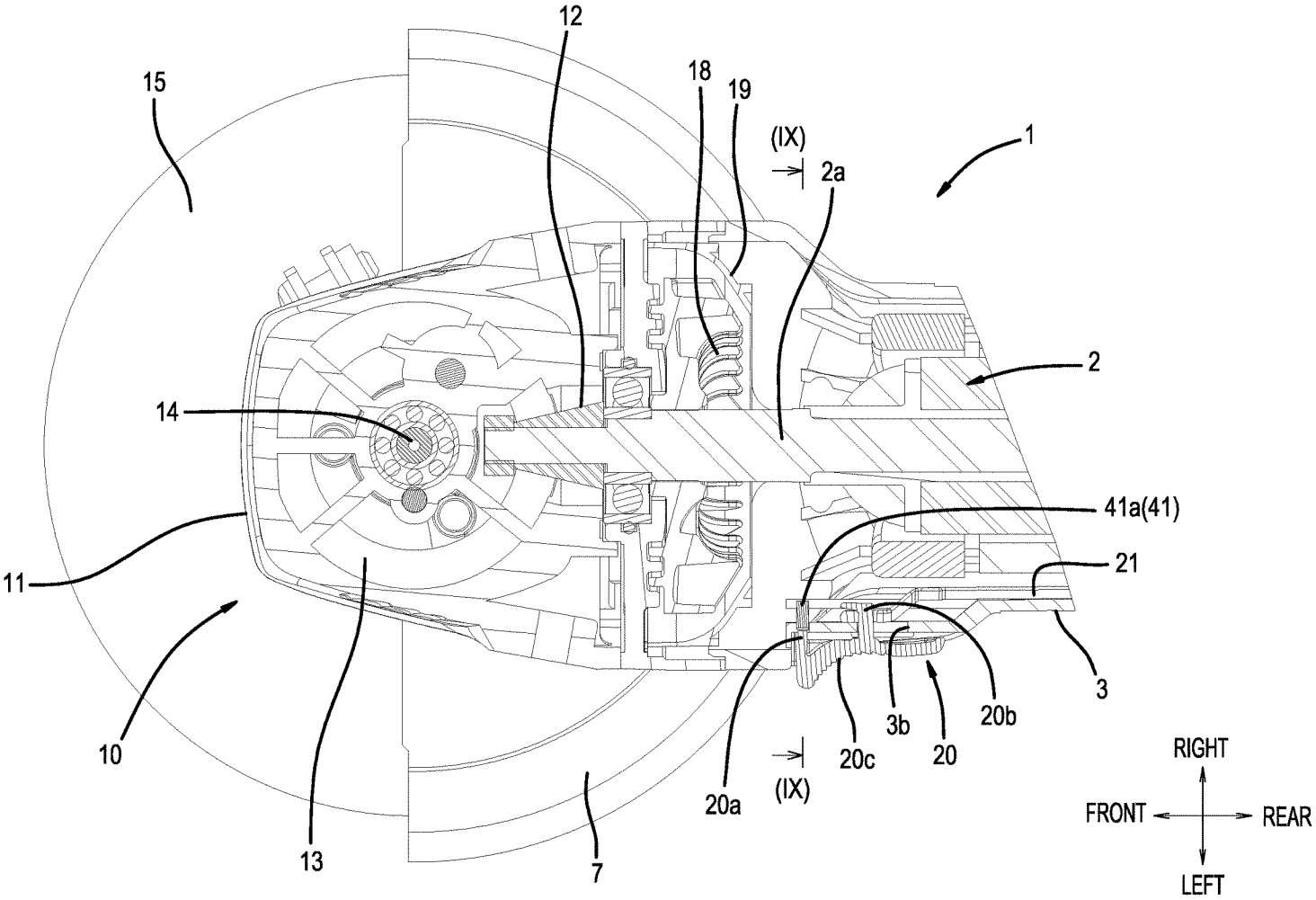
FIG. 8 is another longitudinal-cross-sectional view of the front portion of a power tool according to the second embodiment. This figure shows the state immediately after the lock-ON state of the start switch has been released or disabled.
Figure 10:
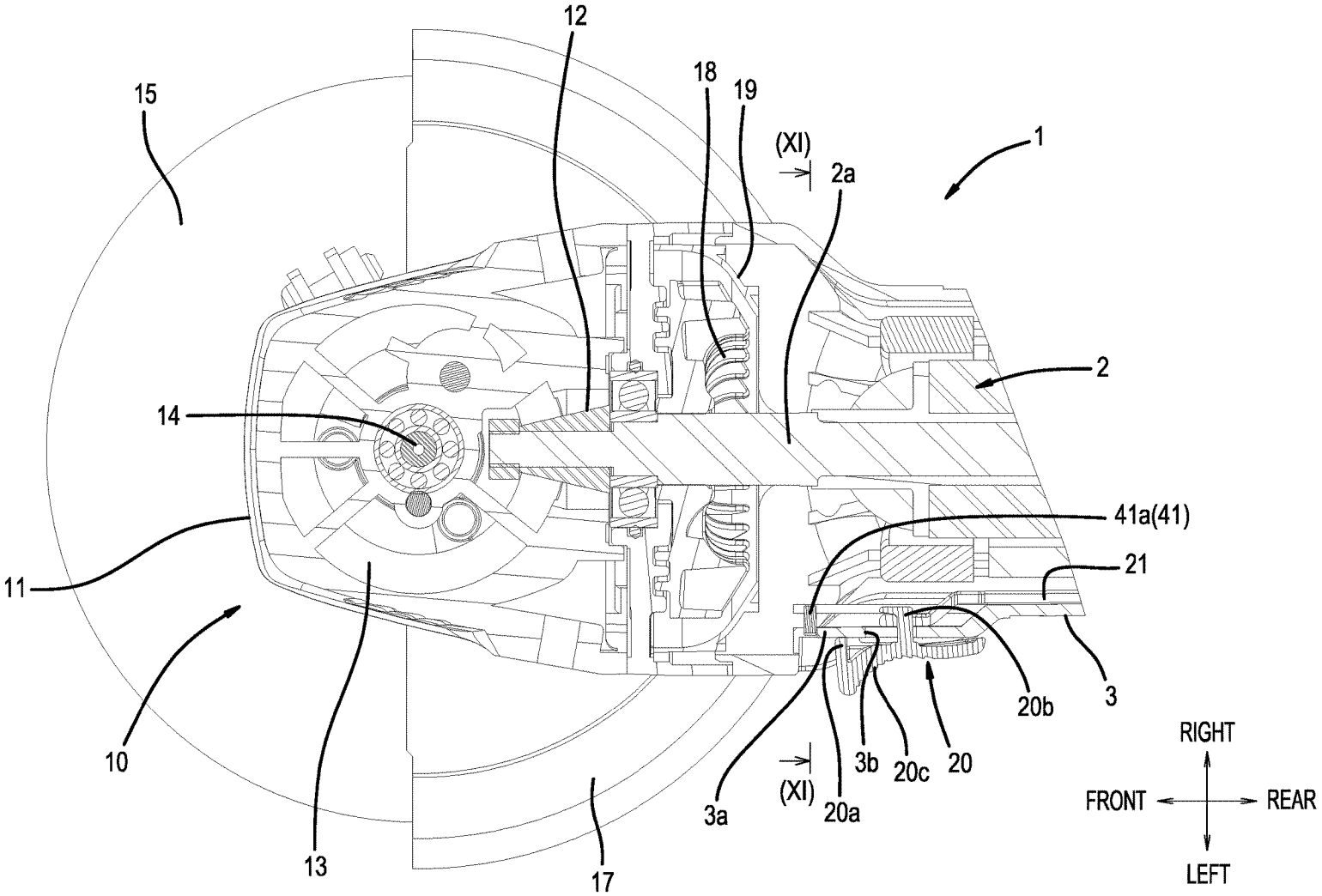
FIG. 10 is another longitudinal-cross-sectional view of the front portion of the power tool according to the second embodiment. This figure shows the state in which the lock-ON state has been released or disabled and the start switch has returned to the OFF position.
Figure 11:
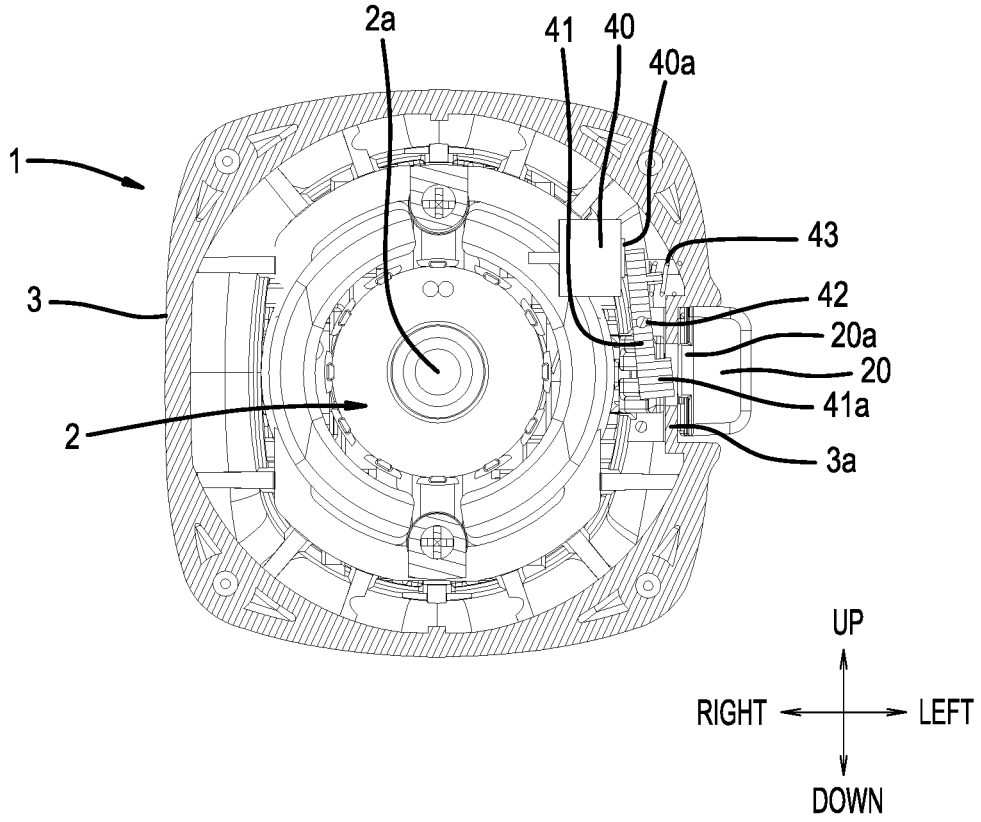
FIG. 11 is a cross-sectional auxiliary view taken along line (XI)-(XI) in FIG. 10. This figure shows the state in which the actuation pin of the electromagnetic actuator has been pulled in, the same as in FIG. 9.

When the intermediate lever 41 is tilted or pivoted in the counterclockwise direction as shown in FIG. 9, the lower side of the engaging part 41*a* (that is, the lower or "down" side as shown in FIG. 9) is displaced in the counterclockwise direction and approaches (moves towards) the end part of the support-pedestal part 3*a*. Consequently, the lock part 20*a* of the start switch 20 is pressed (pushed out), by the engaging part 41*a*, towards the lock-ON-released side (leftward according to the directional arrows in FIG. 9). As shown in FIG. 8 and FIG. 9, when the engaging part 41*a* of the intermediate lever 41 presses (pushes out) the lock part 20*a*, the lock part 20*a* of the start switch 20 separates (disengages or unlatches) from the end part of the support-pedestal part 3*a*, and thus the lock-ON state is released (disabled). When the lock-ON state is released, the start switch 20 returns to the OFF position, as shown in FIG. 10 and FIG. 11, owing to the biasing force of the tension spring 22 acting via the connecting rod 21.

The second embodiment thus also has a configuration in which, when the supply of electric power is cut off, the lock-ON state of the start switch 20 is released (disabled) by the movement of the actuation pin 40*a* of the electromagnetic actuator 40. Therefore, the controller for motor control can be simplified and made more compact as compared with the configuration in which the lock-ON state is electrically released in the actuation control of the electric motor, as in the above-described known example.

In addition, when the power-supply cord 6 is pulled out of the power-supply outlet after usage of the power tool 1 has concluded, the actuation pin 40*a* of the electromagnetic actuator 40 will be held in the pushed out (advanced) state (i.e. it is maintained in the pushed out or advanced position). Therefore, the engaging part 41*a* of the intermediate lever 41 remains at the front side of the end part of the support-pedestal part 3*a*. Consequently, the start switch 20 cannot be pushed into the lock-ON position due to the blocking effect of the engaging part 41*a*. It follows from this that, even if, for example, some other structure or a person interferes with (accidentally slides) the start switch 20 to its ON position while the power tool 1 is not being used to process a workpiece, the start switch 20 can not be placed (intentionally or unintentionally) into the lock-ON state. Therefore, the power tool 1 will not inadvertently start when the power tool 1 is subsequently re-connected to a supply of power, i.e. when the cord 6 is plugged into a power-supply outlet again.

Figure 12:
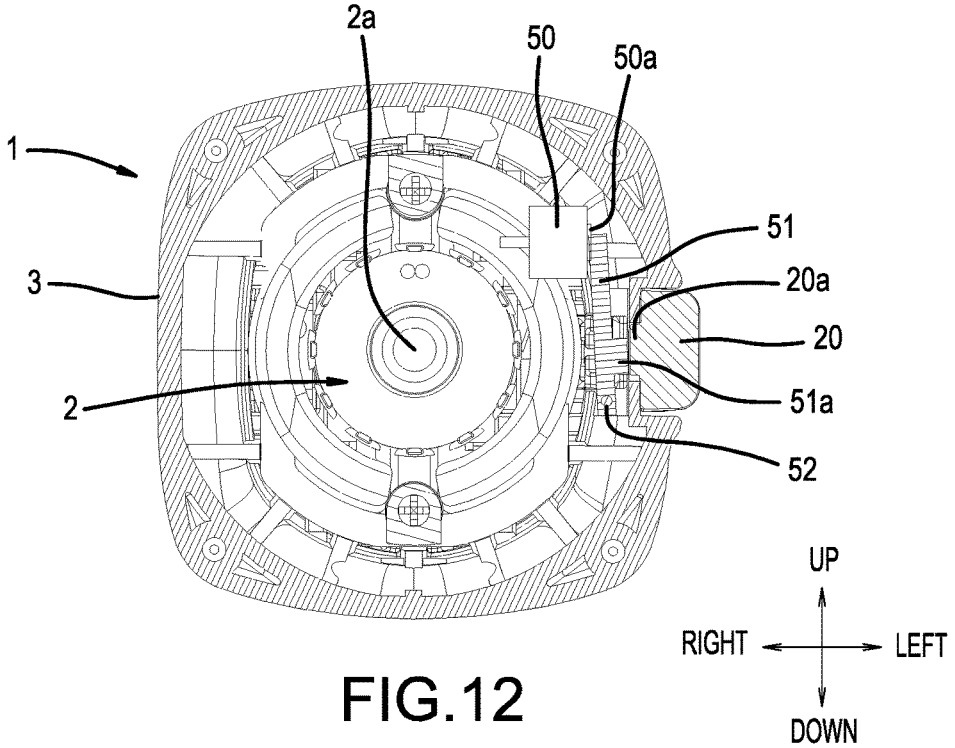
FIG. 12 is a transverse cross-sectional view of a power tool according to a third embodiment. This figure shows the start switch in the lock-ON state and shows the state in which the actuation pin of the electromagnetic actuator has been pulled in due to the supply of electric current.
Figure 13:
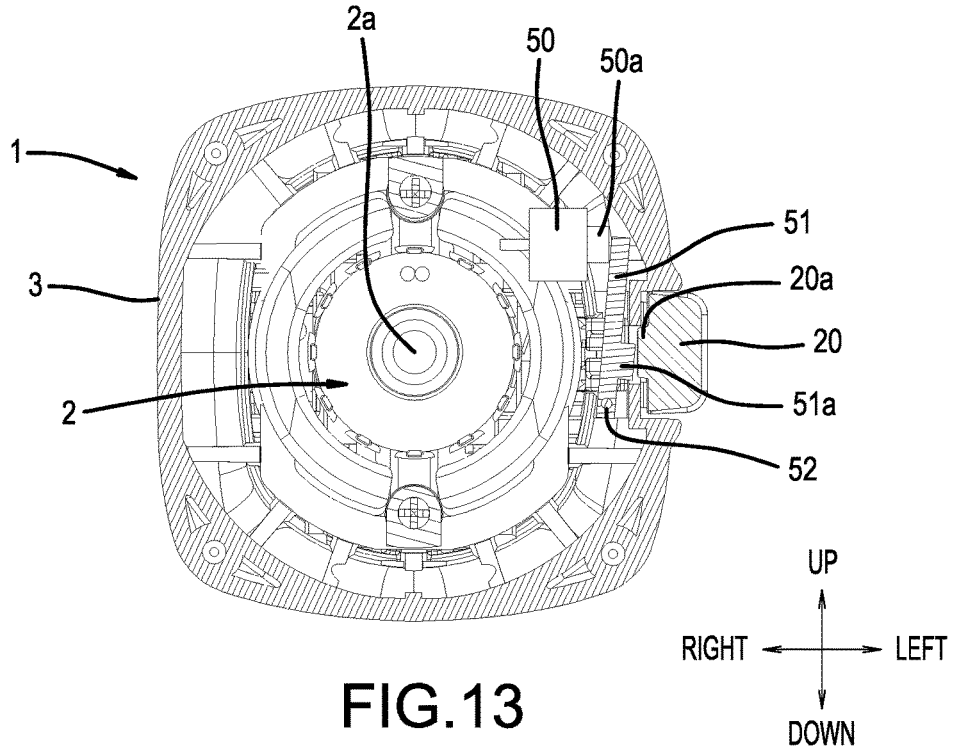
FIG. 13 is another transverse cross-sectional view of the power tool according to the third embodiment. This figure shows the state in which the actuation pin of the electromagnetic actuator has been pushed out due to the supply of electric current being cut off and shows the state in which the release of the lock-ON state of the start switch is in progress.

FIG. 12 and FIG. 13 show the power tool 1 according to a third embodiment. In the third embodiment, the support for an intermediate lever 51 and an electromagnetic actuator 50 differs from that of the second embodiment. The third embodiment utilizes an electromagnetic actuator of the same type as that of the first embodiment, that is, a type in which an actuation pin 50*a* is pushed out (advanced) when the supply of electric current is cut off. In addition, in the third embodiment, the intermediate lever 51 is also supported such that it is capable of pivoting (tilting) about a pivot 52. But, in the third embodiment, the pivot 52 is located at one end (the lower end in FIGS. 12 and 13) of the intermediate lever 51 in the longitudinal direction, rather than in the middle of the intermediate lever (41). An engaging (contacting) part 51*a* is provided on the intermediate lever 51 at an intermediate, e.g., substantially central, position between the longitudinal ends of the intermediate lever 51.

The electromagnetic actuator 50 is disposed on one side of the upper end portion of the intermediate lever 51. When the actuation pin 50*a* of the electromagnetic actuator 50 is pulled in (retracted into the body of the actuator 50) by supplying electric current to the electromagnetic actuator 50, the intermediate lever 51 is tilted (pivoted) about the pivot 52 in the counterclockwise direction, as shown in FIG. 12, owing to the biasing force of a not-shown compression spring (similar to the compression spring 43 of the second embodiment). Consequently, as shown in FIG. 12, the engaging part 51*a* is displaced (pivoted) in the counterclockwise direction with respect to the pivot 52 away from the end part of the support-pedestal part 3*a*. It follows that, while electric power is being supplied to the power tool 1 and thus to the actuator 50, the lock part 20*a* can be caught by (latched on) the end part of the support-pedestal part 3*a*, and therefore the start switch 20 can be pushed into the lock-ON position (the lock-ON state is enabled).

On the other hand, when the supply of electric power to the power tool 1 is cut off (interrupted) and thus the supply of electric current to the electromagnetic actuator 50 is also cut off (interrupted), the actuation pin 50*a* of the electromagnetic actuator 50 is pushed out (is advanced out of the body of the actuator 50), as shown in FIG. 13. When the actuation pin 50*a* is pushed out, the upper part of the intermediate lever 51 is pressed thereby, and the intermediate lever 51 tilts (pivots) about the pivot 52 in the clockwise direction, as shown in FIG. 13. Consequently, the engaging (contacting) part 51*a* of the intermediate lever 51 is displaced (pivoted) to a position at which it is adjacent to (contacts and presses) the front side of the front-end part of the support-pedestal part 3*a*, whereby the lock part 20*a* of the start switch 20 is pressed (pushed) out of the locked ON position and the lock-ON state of the start switch 20 is released (disabled).

In addition, because the engaging part 51*a* of the intermediate lever 51 is positioned (located) at the front side of the front-end part of the support-pedestal part 3*a* when the supply of electric power is cut off, the lock part 20*a* of the start switch 20 cannot be caught by (latched on) the front-end part of the support-pedestal part 3*a*. Consequently, when the supply of electric power is cut off, the start switch 20 cannot be placed in the lock-ON position (state) due to the blocking effect of the engaging part 51*a*.

According to the third embodiment, a configuration is again adopted in which the lock-ON state of the start switch 20 is released (disabled) by the electromagnetic actuator (50), and therefore the controller for motor control can be simplified and made more compact as compared with the above-described known configuration in which the lock-ON state is electronically released in the actuation control of the electric motor.

In addition, according to the third embodiment as well, when the supply of electric power is cut off (interrupted), the start switch 20 cannot be pushed into the lock-ON position. Therefore, even if some other member (structure) or a person interferes with (accidentally pushes) the start switch 20 when the power tool 1 is not being used for workpiece processing (e.g., during storage), the start switch 20 can not be put (intentionally or unintentionally) into the lock-ON state. Consequently, the power tool 1 will not inadvertently start when the supply of electric power is subsequently connected to the power tool 1 again.

FIGS. 14-17 show the power tool 1 according to a fourth embodiment. The power tool 1 of the fourth embodiment comprises, as the switch that starts and stops the electric motor 2, a large-lever-type start switch 61 that differs from the sliding-type start switch 20 of the first to third embodiments. Members and structural elements that are the same as those in the first to third embodiments are assigned the same reference numbers, and redundant explanations thereof are therefore omitted.

The start switch 61 has an elongated lever shape and may be referred to as a "paddle switch". The start switch 61 is disposed such that it extends from the lower surface of the front part of the main-body housing 3 to the rear part of the lower surface of the rear-part case 4. The start switch 61 is supported such that it is capable of tilting (pivoting) up and down (according to the directional arrows shown in FIG. 14), wherein the front-end part is engaged (joined or hinged) with the main-body housing 3 and serves as a fulcrum (pivot point). A front-side-grip part 61*a* and a rear-side-grip part 61*b* are provided on the start switch 61. The user can start the electric motor 2 by pulling on (squeezing) either the front-side-grip part 61*a* or the rear-side-grip part 61*b*. That is, when the user grasps (holds) the main-body housing 3, the electric motor 2 can be started by pulling on (squeezing) the front-side-grip part 61*a*. On the other hand, when the user grasps (holds) the rear-part case 4, the electric motor 2 can be started by pulling on (squeezing) the rear-side-grip part 61*b*, which makes the power tool 1 easier to operate in a variety of grasping positions.

Figure 14:
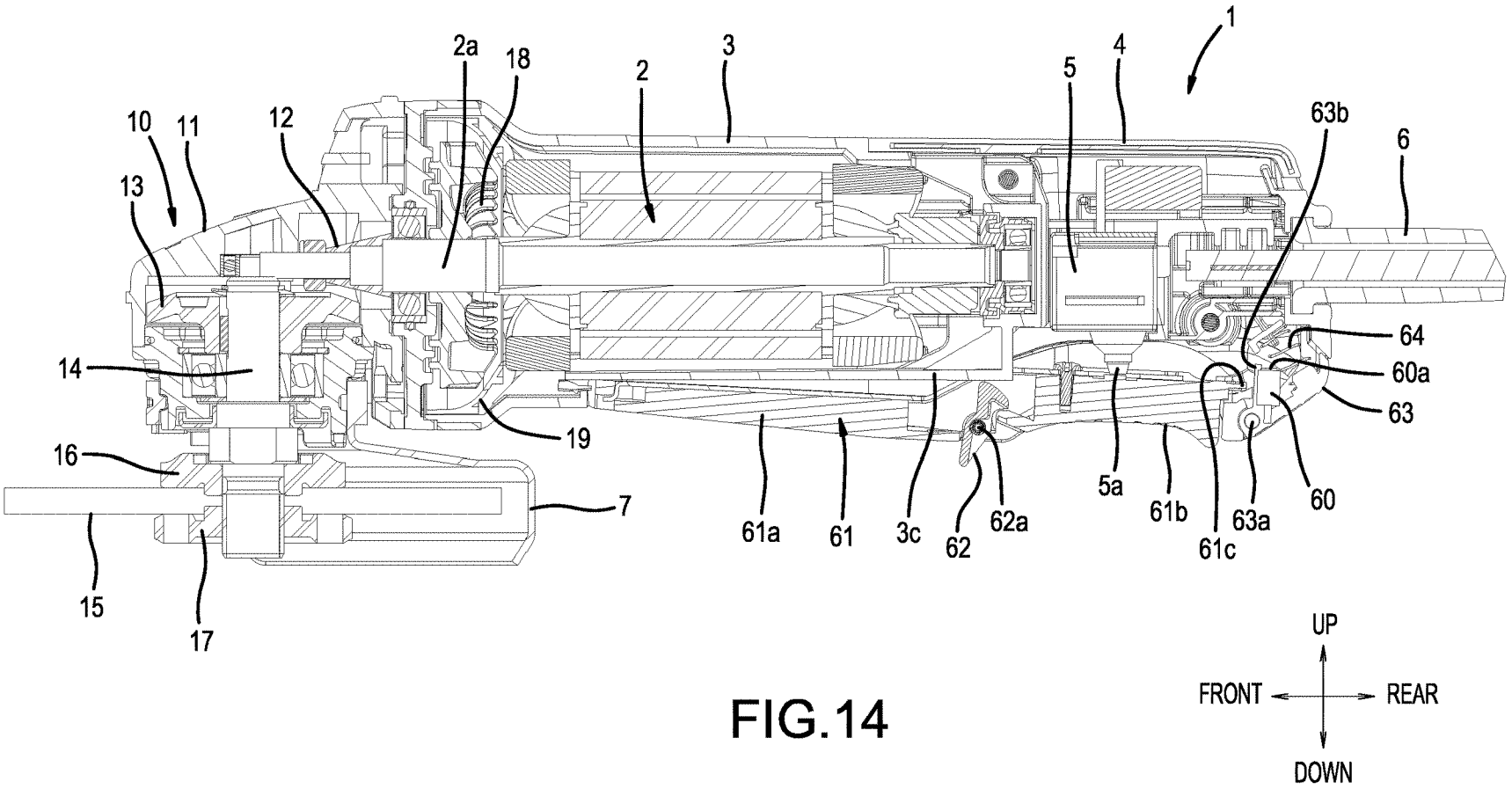
FIG. 14 is an overall-longitudinal-cross-sectional view of a power tool according to a fourth embodiment. This figure shows a lock-OFF state in which the start switch is locked at an OFF position by a lock-OFF lever. This figure shows the state in which the actuation pin of the electromagnetic actuator has been pulled in due to the supply of electric current.
Figure 15:
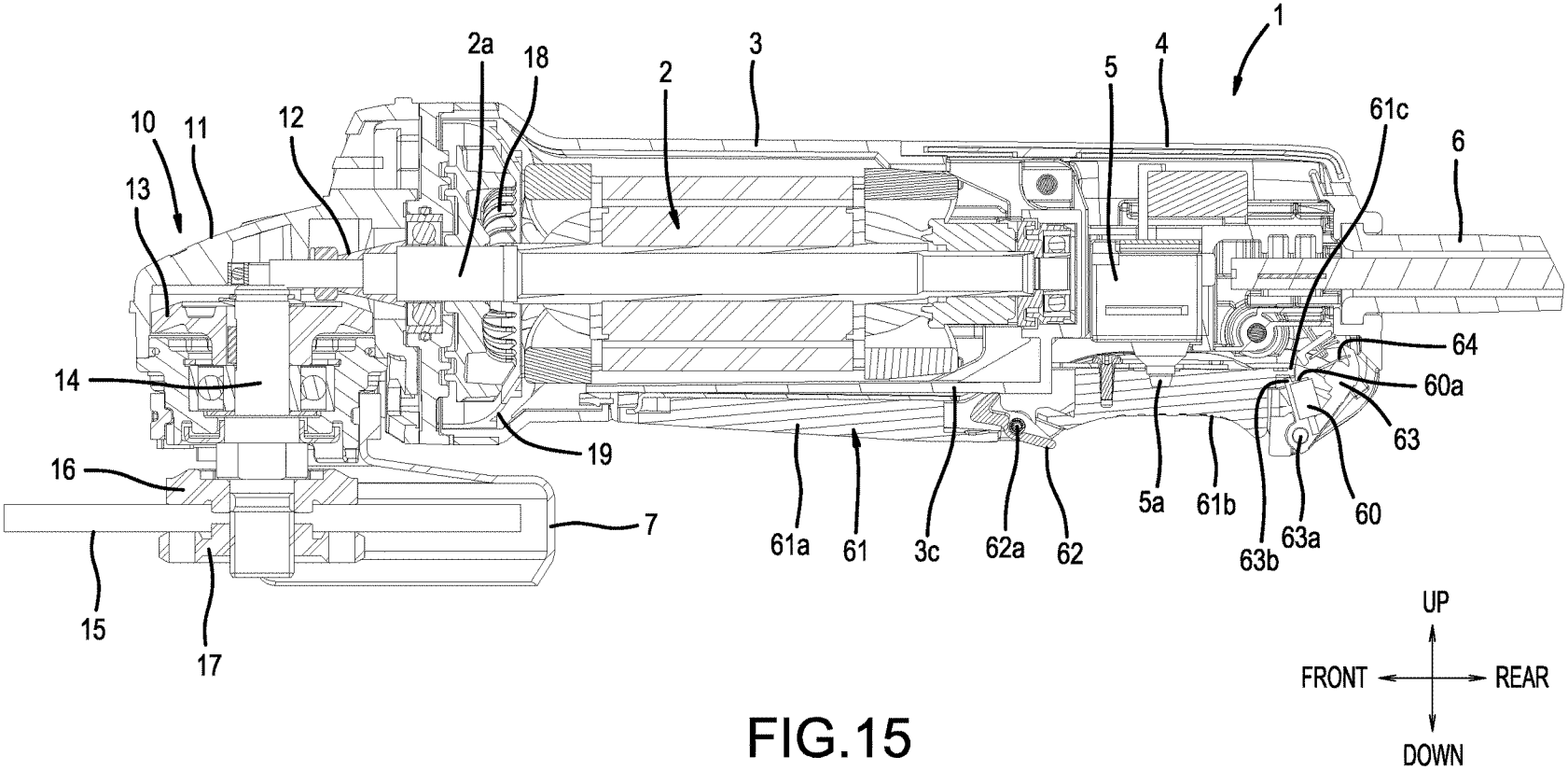
FIG. 15 is another overall-longitudinal-cross-sectional view of the power tool according to the fourth embodiment. This figure shows the lock-ON state in which the lock-OFF lever has been pivoted out of contact with the main housing and a lock-ON lever has been operated (pivoted) to lock the start switch at (in) its ON position (i.e. in the lock-ON state).

A lock-OFF lever 62 is provided on the start switch 61 between the front-side-grip part 61*a* and the rear-side-grip part 61*b*. The function of the lock-OFF lever 62 is to lock the start switch 61 at (in) its OFF position in order to prevent the start switch 61 from being turned ON inadvertently. The lock-OFF lever 62 is supported such that it is capable of tilting (pivoting) frontward and rearward (clockwise and counterclockwise) about a pivot 62*a*. The lock-OFF lever 62 is biased toward a standing or vertical position (a lock-OFF position), as is shown in FIG. 14, by a not-shown return spring. As shown in FIG. 14, when the lock-OFF lever 62 is stood up (i.e., is generally perpendicular to a longitudinal axis of the power tool main body housing 3), an upper part thereof contacts a contact part 3*c* of the main-body housing 3. Consequently, the start switch 61 cannot be pulled (squeezed) towards the upper side (the ON side), as shown in FIG. 14. On the other hand, when the lock-OFF lever 62 is tipped (rotated) in the counterclockwise direction against the spring biasing force as shown in FIG. 15, the upper part of the lock-OFF lever 62 is displaced (rotated) in the downward direction. As a result, the start switch 61 can now be pulled (squeezed upward) towards the ON side.

The switch main body 5 is located within the main-body housing 3 upward of the rear-side-grip part 61*b*. The switch main body 5 turns ON when the rear-side-grip part 61*b* of the start switch 61 presses (pushes upward) the actuation button 5*a* into the switch main body 5. A lock-ON lever 63 is provided at (adjacent) the rear side of the start switch 61. The lock-ON lever 63 is supported by the rear-part case 4 so that the lock-ON lever 63 is capable of tilting (pivoting) upward and downward (i.e. clockwise and counterclockwise) about a pivot 63*a*. The lock-ON lever 63 is biased towards the lock-ON-released side (the clockwise direction in FIGS. 14-17) by a compression spring 64.

A lock part 63*b* is provided integrally with the lock-ON lever 63. The lock part 63*b* extends upward from the vicinity of the pivot 63*a*. An electromagnetic actuator 60 is supported along (held by) the lock part 63*b*. Therefore, the electromagnetic actuator 60 displaces (pivots) integrally with the lock-ON lever 63. The fourth embodiment utilizes an actuator of the type in which an actuation pin 60*a* is pulled in (retracted) by the supply of electric current, the same as in the first embodiment. Therefore, when the supply of electric current is cut off (interrupted), the actuation pin 60*a* is pushed out (advanced out of the body of the actuator 60). In FIG. 14, when the power-supply cord 6 is connected to a power-supply outlet (mains power) and thereby electric power is supplied to the power tool 1, electric current is supplied to the electromagnetic actuator 60 and thus the actuation pin 60*a* is pulled into the body of the electromagnetic actuator 60.

When electric power is being supplied, as shown in FIG. 15, the lock-OFF state can be released (disabled) by tipping (pivoting) the lock-OFF lever 62 in the counterclockwise direction against the spring biasing force that is continuously applied by the not-shown return spring by using the fingertip of the hand that grasps the main body housing 3 or the rear part of the case 4. If the start switch 61 is then pulled upward (squeezed toward the interior of the housing 3) while maintaining the lock-OFF-released state, then the actuation button 5*a* of the switch main body 5 is pressed by the rear-side-grip part 61*b* and thereby the switch main body 5 turns ON. When the switch main body 5 turns ON, the electric motor 2 starts and the grinding wheel 15 rotates.

When the start switch 61 is pulled in (the ON state of the switch main body 5) and the lock-ON lever 63 is subsequently pushed in against the compression spring 64, then the lock part 63*b* and the electromagnetic actuator 60 integrally displace (pivot) upward and forward (i.e. counterclockwise) about the pivot 63*a* and along an arcuate path. At this time, the actuation pin 60*a* of the electromagnetic actuator 60 displaces (moves) towards the pulled-in (lower) side of the start switch 61 (in particular, towards an engaging (contact) part 61*c*). By then engaging (abutting) the tip of the counterclockwise-pivoted lock part 63*b* with (on) the lower surface of the raised (upward tilted) engaging part 61*c* provided on a rear-end portion of the start switch 61, the start switch 61 is prevented (blocked) from returning (pivoting clockwise) towards its OFF position. In this respect, the engaging (contact) part 61*c* may be formed as a lip or flange at the end of the rear-side-grip part 61*b* of the start switch 61 that is designed to catch or latch the upper (terminal) end of the lock part 63*b*. Therefore, the start switch 61 is held in the lock-ON state by the abutment of the lock part 63*b* on the engaging (contact) part 61*c* while the actuation pin 60*a* is pulled into the body of the electromechanical actuator 60, as shown in FIG. 15.

In other words, by engaging (abutting) the forward-pivoted lock part 63*b* with (on) the upward-tilted engaging part 61*c* from below, the lock-ON state results in which the start switch 61 is locked at the ON position and it is prevented (blocked) from returning (pivoting downward or clockwise) towards its OFF position. In addition, by engaging (abutting) the lock part 63*b* with (on) the engaging part 61*c* from below, the lock-ON lever 63 is prevented or blocked from pivoting in the clockwise direction according to FIGS. 14-17, and the lock-ON lever 63 is held in the pushed-in position (lock-ON position).

To manually release the lock-ON state, the user's grip may be strengthened (i.e. the start switch 61 is squeezed upward towards the housing 3) so that the start switch 61 is displaced slightly upward; thereby, the engaging part 61*c* is retracted upward and away from the lock part 63*b*. When the engaging part 61*c* is slightly retracted (pulled) upward away so as to be spaced apart or separated from the lock part 63*b* (and the actuation pin 60*a* is in its retracted position), the lock-ON lever 63 will automatically pivot in the clockwise direction past the raised engaging part 61*c* owing to the biasing force of the compression spring 64. Therefore, the lock-ON lever 63 will return to its lock-ON-released position, which is shown in FIG. 14. Subsequently, if the grip on the start switch 61 is released (i.e. the start switch 61 is no longer squeezed), then the actuation button 5*a* projects (advances) outward (downward in FIGS. 14-17) from the switch main body 5, which turns OFF and thereby stops the electric motor 2.

Figure 16:
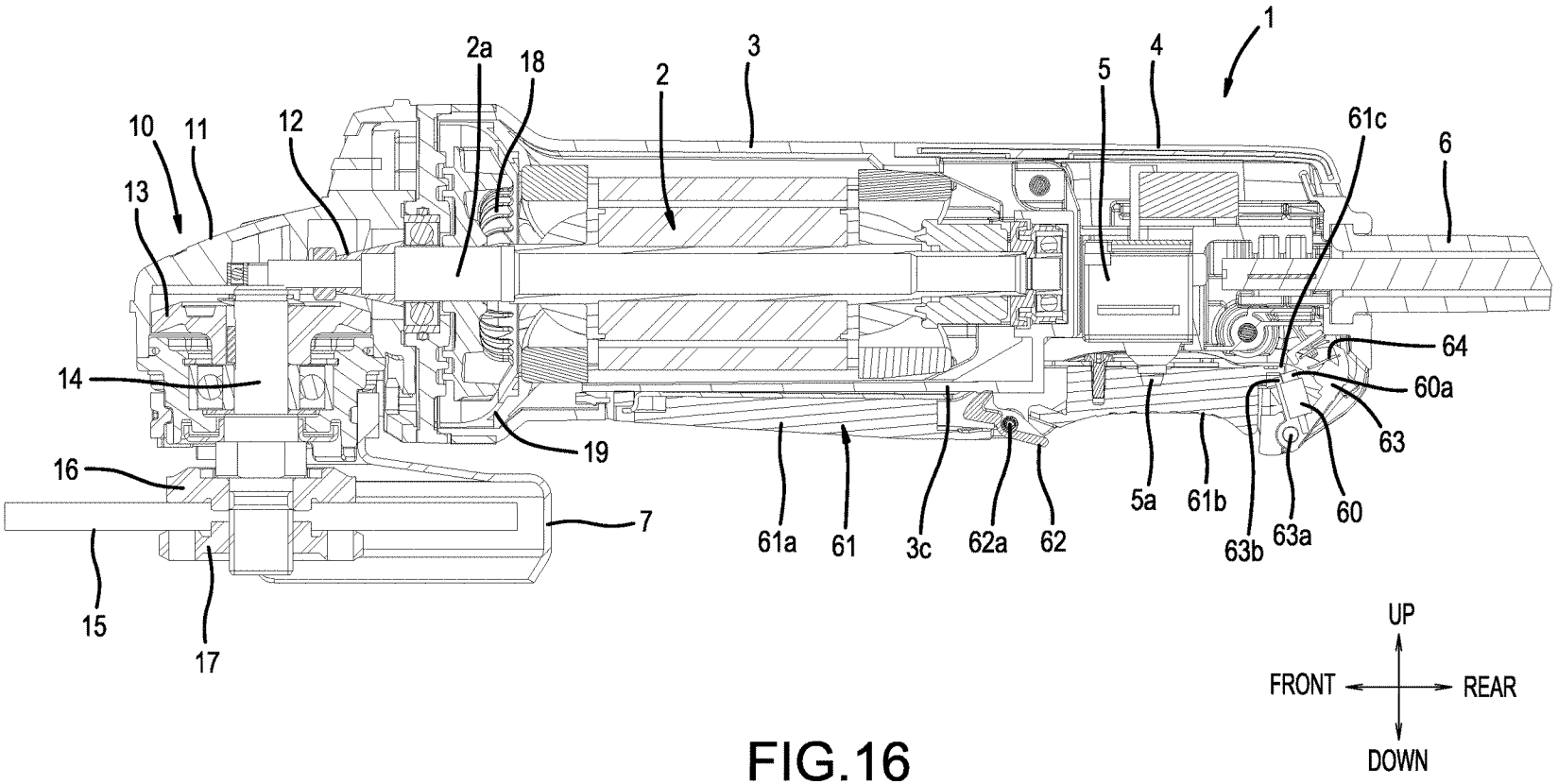
FIG. 16 is another overall-oblique view of the power tool according to the fourth embodiment. This figure shows the state immediately after the actuation pin of the electromagnetic actuator has been pushed out due to the supply of electric current being cut off.
Figure 17:
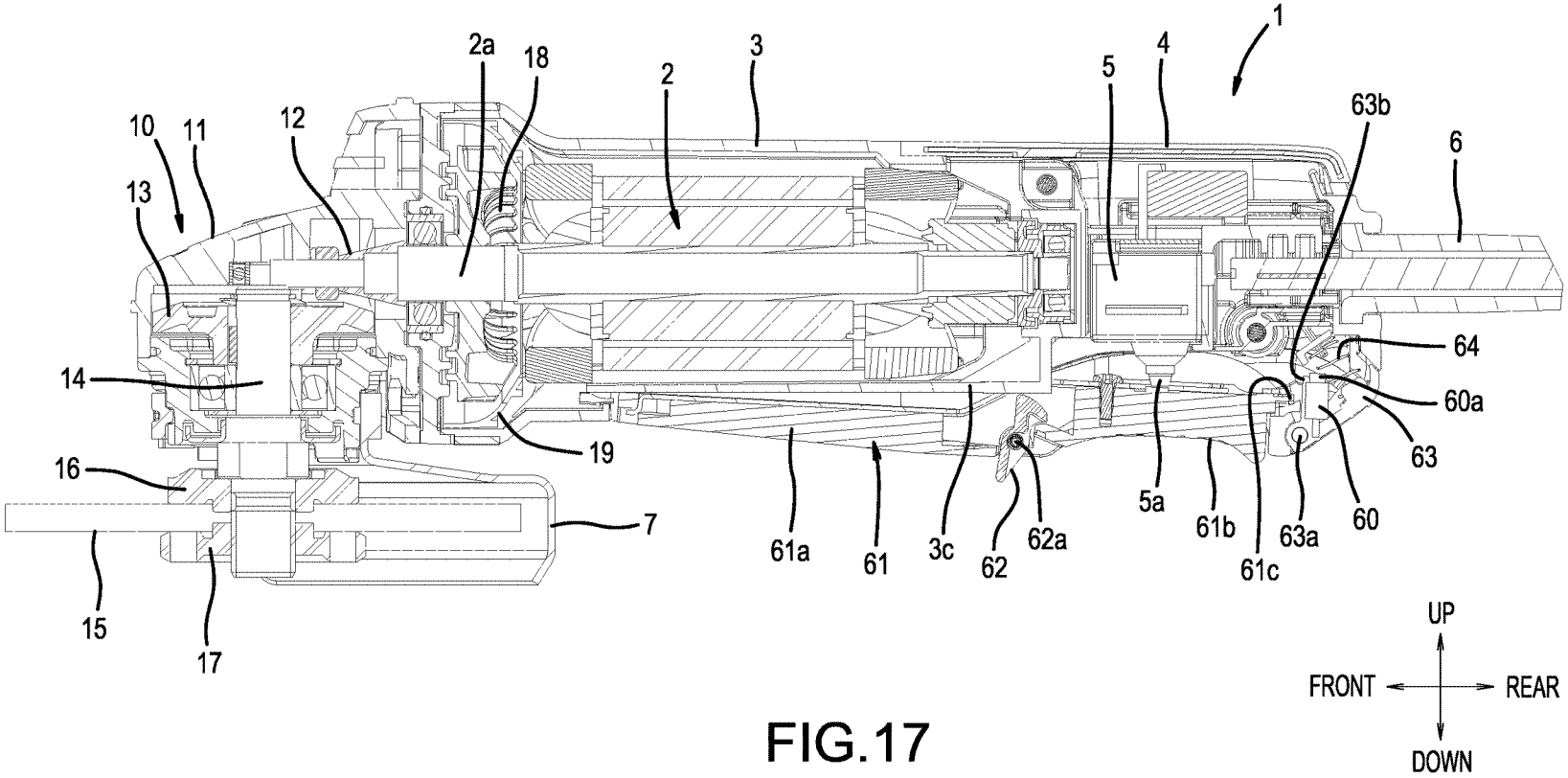
FIG. 17 is another overall-oblique view of the power tool according to the fourth embodiment. This figure shows the lock-OFF state in which the lock-ON state has been released and the start switch is locked at the OFF position by the lock-OFF lever being pivoted back into contact with the main housing. This figure differs from FIG. 14 in that it shows the state in which the supply of electric current has been cut off and the actuation pin of the electromagnetic actuator is pushed out.

If the supply of electric power is cut off (interrupted) in the lock-ON state set by the counterclockwise-pivoted lock-ON lever 63, then the supply of electric current to the electromagnetic actuator 60 is cut off (interrupted). As shown in FIG. 16, the actuation pin 60*a* is pushed out by the cut off (interruption) of the supply of electric current to the electromagnetic actuator 60. When the actuation pin 60*a* is pushed out, the engaging part 61*c* is pushed slightly upward by the actuation pin 60*a*. Because the advancing actuation pin 60*a* presses upward and the engaging part 61*c* retracts (pivots counterclockwise), the lock part 63*b* disengages (separates) from the engaging part 61*c*. When the lock part 63*b* thus no longer contacts (disengages or separates from) the engaging part 61*c*, the lock-ON lever 63 automatically pivots in the clockwise direction owing to the biasing force of the compression spring 64 in the same manner as in the case of the manual release discussed above. For example, the terminal end of the actuation pin 60*a* may contact an edge of the engaging part 61*c* at an angle such that the actuation pin 60*a* slides off and away from the engaging part 61*c* owing to the biasing force of the compression spring 64. Therefore, the lock-ON lever 63 returns to the lock-ON-released position shown in FIG. 17.

According to the power tool 1 of the fourth embodiment as explained above, a configuration is again adopted in which the lock-ON state of the start switch (61) is released (disabled) by the electromagnetic actuator (60), and therefore the controller for motor control can be simplified and made more compact than in the above-described known configuration in which, the lock-ON state is electrically released in the actuation control of the electric motor.

In addition, according to the fourth embodiment as well, when the supply of electric power is cut off, the actuation pin 60*a* of the electromagnetic actuator 60 is pushed out. Consequently, even if the start switch 61 is mistakenly pulled (squeezed) and the lock-ON lever 63 is pressed in, the start switch 61 is prevented or blocked from locking in the ON position (i.e. the lock-ON state is disabled), and therefore the power tool 1 will not inadvertently start when it is connected to a supply of electric power again.

Each embodiment as explained above can be supplemented with additional modifications. For example, by using an electromagnetic actuator in which the direction of the actuation (movement) of the actuation pin is the reverse of that in the first embodiment, it is possible to adopt a configuration in which the lock part 20*a* of the start switch 20 directly engages with (latches) the actuation pin of the electromagnetic actuator in order to lock the start switch 20 in the ON position, i.e. the lock part 20*a* engages/contacts the actuation pin instead of the front-end part of the support-pedestal part 3*a*. In such an embodiment, if the supply of electric current to the electromagnetic actuator is cut off, then the actuation pin is pulled in (retracted) and the engagement (latching) of the lock part 20*a* with the actuation pin is released, whereby the lock-ON state of the start switch 20 is released (disabled).

In addition, power tools are illustrated in which an AC power supply (mains power) serves as the power supply, but the present disclosure can likewise be adapted to power tools in which a rechargeable battery pack is used as the power supply. The present techniques are particularly advantageous in the situation in which the charge of the rechargeable battery runs out while the power tool is operating in the lock-ON state. If the start switch is not moved out of the ON position (e.g., by an electromagnetic actuator according to the present disclosure), the power tool will start operating, possibly detrimentally to the user, as soon as a recharged battery pack is mounted on the power tool. Such a power tool optionally can be designed such that the electromagnetic actuator is actuated to disable the lock-ON state when the remaining charge of the battery pack falls below a predetermined threshold, to reduce the likelihood that the rechargeable battery will reach an over-discharged state that could permanently damage the rechargeable battery.

Furthermore, although a disc grinder was illustrated as the power tool 1, the same functions and effects also can be obtained with other power tools, such as cutting machines (e.g., reciprocating saws), screwdrivers, polishers, sanders, etc., by using an electromagnetic actuator as described above to automatically release (disable) a lock-ON mechanism when the supply of electric power is cut off (interrupted).

Each of the electromagnetic actuators 30, 40, 50, 60 disclosed herein may be embodied as an electromechanical solenoid having an electromagnetically-inductive coif wound around a movable steel or iron pin (actuation pin), which may also be called a plunger or armature. The coil is shaped such that the pin moves either in or out of the center of the coil in response to energization of (supply of electric current to) the coil. A return spring biases the pin in a direction opposite of the direction that the magnetic field generated by the coil pulls the pin when the coil is energized. Therefore, in the absence of the magnetic field (i.e. when the current to the coil is interrupted), the pin will move in the direction of the biasing force of the return spring.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved power tools.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Power tool (disc grinder)
2 Electric motor
2*a* Output shaft
3 Main-body housing
3*a* Support-pedestal part
3*b* Insertion-window part
3*c* Contact part
4 Rear-part case
5 Switch main body
5*a* Actuation button
6 Power-supply cord
7 Grinding-wheel cover
10 Gear-head part
11 Gear-head case
12 Bevel gear (drive side)
13 Bevel gear (follower side)
14 Spindle
15 Grinding wheel
18 Cooling fan
19 Baffle plate
20 Start switch
20*a* Lock part
20*b* Arm part
20*c* Pressing part
21 Intermediate lever
22 Tension spring
23 Switch frame

30 Electromagnetic actuator (first embodiment)
30*a* Actuation pin
40 Electromagnetic actuator (second embodiment)
40*a* Actuation pin
41 Intermediate lever
41*a* Engaging part
42 Pivot
43 Compression spring
50 Electromagnetic actuator (third embodiment)
50*a* Actuation pin
51 Intermediate lever
51*a* Engaging part
52 Pivot
60 Electromagnetic actuator (fourth embodiment)
60*a* Actuation pin
61 Start switch
61*a* Front-side-grip part
61*b* Rear-side-grip part
61*c* Engaging part
62 Lock-OFF lever
62*a* Pivot
63 Lock-ON lever
63*a* Pivot
63*b* Lock part
64 Compression spring

The invention claimed is:

1. A power tool comprising:

an electric motor as a drive source, a start switch configured to start the electric motor, the start switch being movable between an OFF position and an ON position and being engageable or latchable in a lock-ON state, an electromagnetic actuator configured to advance an actuation pin out of a body of the electromagnetic actuator in response to an interruption of a supply of electric current to the power tool, and an intermediate lever operably interposed between the start switch and the electromagnetic actuator, wherein:

the intermediate lever is configured to be tilted or pivoted by the advancing movement of the actuation pin of the electromagnetic actuator to disengage or unlatch the start switch from the lock-ON state and/or to block the start switch from engaging or latching in the lock-ON state.

2. The power tool according to claim 1, wherein:

the start switch is supported by a support-pedestal part of a main-body housing such that it is slidable between the ON position and the OFF position, the start switch is supported in the ON position such that it is tiltable or pivotable between the lock-ON state and a lock-OFF position, and in the ON position, the start switch is tiltable or pivotable to the lock-ON state and is configured to be held at the lock-ON state by engagement of a lock part of the start switch with a portion of the support-pedestal part.

3. A power tool comprising:

an electric motor as a drive source, a start switch configured to start the electric motor, the start switch being movable between an OFF position and an ON position and being engageable or latchable in a lock-ON state, and an electromagnetic actuator configured to retract an actuation pin into a body of the electromagnetic actuator in response to an interruption of a supply of electric current to the power tool, and an intermediate lever operably interposed between the start switch and the electromagnetic actuator, wherein:

the intermediate lever is configured to be tilted or pivoted by the retracting movement of the actuation pin of the electromagnetic actuator to disengage or unlatch the start switch from the lock-ON state and/or to block the start switch from engaging or latching in the lock-ON state.

4. The power tool according to claim 3, wherein:

the start switch is supported by a support-pedestal part of a main-body housing such that it is slidable between the ON position and the OFF position, the start switch is supported in the ON position such that it is tiltable or pivotable between the lock-ON state and a lock-OFF position, and in the ON position, the start switch is tiltable or pivotable to the lock-ON state and is configured to be held at the lock-ON state by engagement a lock part of the start switch with a portion of the support-pedestal part.

5. A power tool comprising:

an electromagnetic actuator configured to shift from a first configuration when the power tool and the electromagnetic actuator are connected to a source of electric current to a second configuration in response to the power tool and the electromagnetic actuator being disconnected from the source of electric current;

an electric motor selectively connectable to the source of electric current by a start switch, the start switch being movable between an OFF position and an ON position and being latchable in a lock-ON state, and a lever having a first end at the actuation pin and a second end at the start switch, wherein shifting the electromagnetic actuator from the first configuration to the second configuration pivots the lever, and the start switch is configured to move from the lock ON state to the OFF position in response to the electromagnetic actuator shifting from the first configuration to the second configuration.

6. The power tool according to claim 5, wherein:

the electromagnetic actuator comprises an actuation pin shiftable from an advanced position to a retracted position and the first configuration of the electromagnetic actuator comprises the electromagnetic actuator with the actuation pin in the advanced position.

7. The power tool according to claim 6, wherein the start switch is configured such that:

the start switch has an end, moving the start switch from the OFF position to the ON position shifts the end in a longitudinal direction of the power tool and moving the start switch from the ON position to the lock-ON state shifts the end of the start switch in a direction different than the longitudinal direction of the power tool.

8. A power tool comprising:

an electromagnetic actuator comprising an actuation pin, the electromagnetic actuator being configured to shift from a first configuration when the power tool and the electromagnetic actuator are connected to a source of electric current to a second configuration in response to the power tool and the electromagnetic actuator being disconnected from the source of electric current and an electric motor selectively connectable to the source of electric current by a start switch, the start switch being movable between an OFF position and an ON position and being latchable in a lock-ON state, wherein:

the start switch is configured to move from the lock ON state to the OFF position in response to the electromagnetic actuator shifting from the first configuration to the second configuration, and the start switch is configured such that:

the start switch has an end, moving the start switch from the OFF position to the ON position shifts the end in a longitudinal direction of the power tool, and moving the start switch from the ON position to the lock-ON state shifts the end of the start switch in a radial direction of a substantially cylindrical housing of the power tool.

9. The power tool according to claim 8, wherein the start switch is spring-biased toward the OFF position.

10. The power tool according to claim 5, wherein:

the start switch is supported by a main-body housing such that it pivotable between the ON position and the OFF position, and when the start switch is pivoted to the ON position, it is holdable in the lock-ON state by a tip part of a pivotable lock-ON lever abutting on a longitudinal end portion of the start switch.

11. A power tool comprising:

an electromagnetic actuator configured to shift from a first configuration when the power tool and the electromagnetic actuator are connected to a source of electric current to a second configuration in response to the power tool and the electromagnetic actuator being disconnected from the source of electric current; and an electric motor selectively connectable to the source of electric current by a start switch, the start switch being movable between an OFF position and an ON position and being latchable in a lock-ON state, wherein:

the start switch is configured to move from the lock ON state to the OFF position in response to the electromagnetic actuator shifting from the first configuration to the second configuration, the start switch is supported by a main-body housing such that it pivotable between the ON position and the OFF position, when the start switch is pivoted to the ON position, it is holdable in the lock-ON state by a tip part of a pivotable lock-ON lever abutting on a longitudinal end portion of the start switch, the lock-ON lever is pivotably supported by a rear-part case of the power tool that is connected to the main-body housing, the electromagnetic actuator is disposed and held on the lock-ON lever so as to move integrally therewith, and the lock-ON lever is spring-biased towards a lock-OFF position.

12. The power tool according to claim 1, further comprising:

a main body housing, a gear head case joined to the main body housing, a spindle driven by the electric motor and protruding from the gear head case, a grinding wheel attached to the spindle, wherein the electric motor and the electromagnetic actuator are disposed in the main body housing and the power tool is a disc grinder.

* * * * *